US007540763B2

(12) United States Patent
Takahashi et al.

(10) Patent No.: US 7,540,763 B2
(45) Date of Patent: Jun. 2, 2009

(54) INTERMEDIATE CONNECTOR

(75) Inventors: Takuya Takahashi, Yamanashi (JP); Takeshi Takahashi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/077,995

(22) Filed: Mar. 24, 2008

(65) Prior Publication Data

US 2008/0182450 A1 Jul. 31, 2008

Related U.S. Application Data

(62) Division of application No. 11/348,856, filed on Feb. 7, 2006, now Pat. No. 7,367,838.

(30) Foreign Application Priority Data

Feb. 15, 2005 (JP) ..... 2005-037641

(51) Int. Cl.
*H01R 12/24* (2006.01)

(52) U.S. Cl. ..... 439/495; 439/73

(58) Field of Classification Search ..... 439/73, 439/493, 495

See application file for complete search history.

(56) References Cited

U.S. PATENT DOCUMENTS

| | | | | |
|---|---|---|---|---|
| 3,851,294 | A * | 11/1974 | Palazzetti et al. | 439/272 |
| 5,316,486 | A * | 5/1994 | Tanaka et al. | 439/62 |
| 5,462,441 | A * | 10/1995 | Renn et al. | 439/67 |
| 5,733,151 | A * | 3/1998 | Edsall et al. | 439/729 |
| 6,595,796 | B1 * | 7/2003 | Koegel et al. | 439/495 |
| 6,837,740 | B2 * | 1/2005 | Kunishi et al. | 439/495 |

FOREIGN PATENT DOCUMENTS

| | | |
|---|---|---|
| JP | 4-501338 | 3/1992 |
| JP | 6076876 | 3/1994 |
| JP | 08-088062 | 4/1996 |
| JP | 9-266038 | 10/1997 |
| JP | 10-255943 | 9/1998 |
| JP | 2003123868 | 4/2003 |
| JP | 2004-39404 | 2/2004 |

* cited by examiner

*Primary Examiner*—Tho D Ta
*Assistant Examiner*—Travis Chambers
(74) *Attorney, Agent, or Firm*—Collard & Roe, P.C.

(57) ABSTRACT

In an electrical connector adapted to be interposed between two connection objects to electrically connect the connection objects to each other, a flexible conductive film, mounted on a base member, includes a flexible insulating film having an outer surface and an inner surface. The flexible insulating film is folded near a rear edge of the base member into a generally U shape with the outer surface kept on the outside. The flexible conductive film has a film conductive pattern formed not only the outer surface of the flexible insulating film but also on the inner surface of the flexible insulating film.

6 Claims, 24 Drawing Sheets

INTERMEDIATE CONNECTOR

CROSS-REFERENCE TO RELATES APPLICATIONS

The present application is a divisional application of U.S. Ser. No. 11/348,856, filed Feb. 7, 2006, now U.S. Pat. No. 7,367,838, the disclosure of which is incorporated herein by reference.

The present application claims priority to prior Japanese application JP 2005-37641, the disclosure of which is incorporated herein by reference.

BACKGROUND OF THE INVENTION

This invention relates to an electrical connector adapted to be interposed between two connection objects to connect these connection objects to each other (hereinafter, the electrical connector will be also called an "intermediate connector").

An electrical connector of the type is disclosed in Japanese Unexamined Patent Publication Tokkai (JP-A) No. H06-76876 under the title of an "anisotropic conductive connector." The anisotropic conductive connector comprises an insulating film, a plurality of fine conductive patterns formed on an outer surface of the insulating film by etching, and a rubber-like elastic member. The insulating film is folded into a generally U shape so that the conductive patterns are exposed outside and the elastic member is interposed between folded portions of the insulating film. Further, the insulating film and the elastic member are fixed to each other. The anisotropic conductive connector is capable of optionally setting the width, alignment pitch, or pattern of conducting fine parallel lines, preventing the removal or deformation of a conductor as the time of cutting out, having high reliability as a contact, and is capable of withstanding the repeated insertion and extraction.

In the anisotropic conductive connector described above, the plurality of fine conductive patterns are formed on only the outer surface of the insulating film. It is therefore difficult to narrow a pitch of the fine conductive patterns.

Another electrical connector of the type is disclosed in Japanese Unexamined Patent Publication Tokkai (JP-A) No. 2003-123868 under the title of a "press-contact connector." The press-contact connector comprises an insulating elastomer, an insulating rubber sheet covering the insulating elastomer and fixed thereto by an adhesive, and a plurality of conductive thin wires arranged along an outer surface of the insulating rubber sheet at a predetermined pitch. In the press-contact connector having such a structure, two circuit boards are electrically connected to each other through the press-contact connector.

In the press-contact connector, the plurality of conductive thin wires are formed on only the outer surface of the insulating rubber sheet at the predetermined pitch. Therefore, it is also difficult to narrow a pitch of the conductive thin wires. In addition, the conductive rubber sheet having almost U-shaped cross section is made to cover a part of the periphery to almost the insulating elastomer. It is therefore difficult to thin the electrical connector.

SUMMARY OF THE INVENTION

It is therefore an object of the present invention to provide an intermediate connector which is capable of preventing a short circuit at a narrower pitch.

It is another object of the present invention to provide an intermediate connector which is capable of thinning the connector.

Other objects of this invention will become clear as the description proceeds.

On describing the gist of a first aspect of this invention, it is possible to be understood that an electrical connector is adapted to be interposed between first and second connection objects to electrically connect the first and the second connection objects to each other. The electrical connector comprises a base member of a plate-like shape having upper and lower surfaces opposite to each other in a thickness direction. The base member has front and rear edges opposite to each other in a back-and-forth direction. Mounted on the base member, the flexible conductive film includes a flexible insulating film having an outer surface and an inner surface opposite to each other. The flexible insulating film is folded near the rear edge of the base member into a generally U shape with the outer surface kept on the outside. The flexible conductive film comprises a film conductive pattern for electrically connecting the first connection object with the second connection object. Upper and lower elastic members are fixed to the upper and the lower surfaces of the base member, respectively. The upper and the lower elastic members are interposed between the flexible conductive film and the base member. According to the first aspect of this invention, in the above-mentioned electrical connector, the film conductive pattern is formed not only on the outer surface of the flexible insulating film but also on the inner surface of the flexible insulating film.

On describing the gist of a second aspect of this invention, it is possible to be understood that a connecting tool is for electrically connecting a first connection objection board with a second connection objection board through an electrical connector interposed between the first connection objection board and the second connection objection board. The connecting tool comprises a base mounted on the second connection objection board, a cover for covering the base, a shaft for rotatably supporting the cover on the base, and a pusher, held in the cover, for pushing the first connection objection board toward the electrical connector. According to the second aspect of this invention, the connecting tool further comprises a first urging member for urging the cover so as to rotate the cover around the shaft in a direction that pushes the pusher and a second urging member for urging the pusher so as to move the pusher away from the electrical connector.

On describing the gist of a third aspect of this invention, it is possible to be understood that a connecting device comprises an electrical connector interposed between a first connection objection board and a second connection objection board, and a connecting tool for electrically connecting the first connection objection board with the second connection objection board through the electrical connector. The connecting tool comprises a base mounted on the second connection objection board, a cover for covering the base, a shaft for rotatably supporting the cover on the base, and a pusher, held in the cover, for pushing the first connection objection board toward the electrical connector. According to the third aspect of this invention, in the connecting device, the connecting tool further comprises a first urging member for urging the cover so as to rotate the cover around the shaft in a direction that pushes said pusher, and a second urging member for urging the pusher so as to move the pusher away from the electrical connector.

DESCRIPTION OF THE PREFERRED EMBODIMENTS

Figure 1:
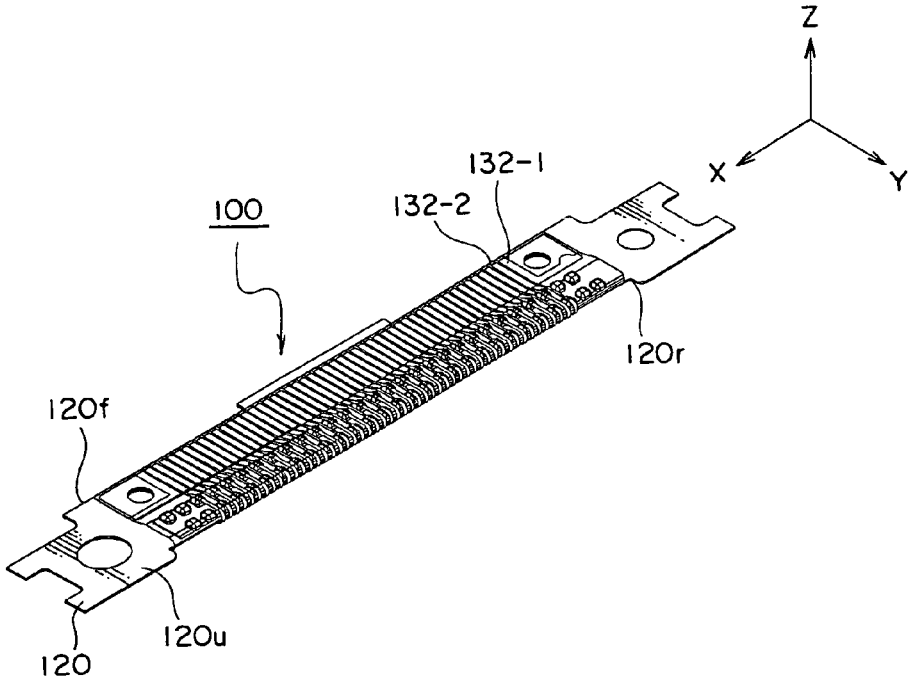
FIG. 1 RELATED ART
FIG. 1 is a perspective view of a related electrical connector.
Figure 2:
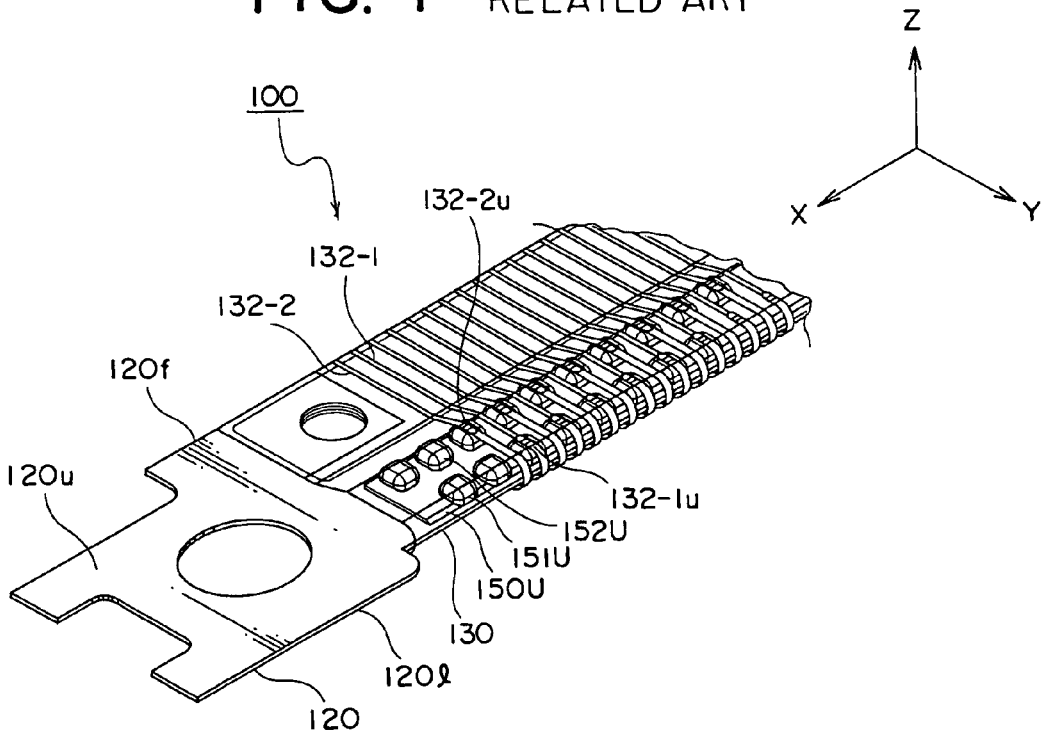
FIG. 2 RELATED ART
FIG. 2 is an enlarged perspective view of the related electrical connector illustrated in FIG. 1.
Figure 3:
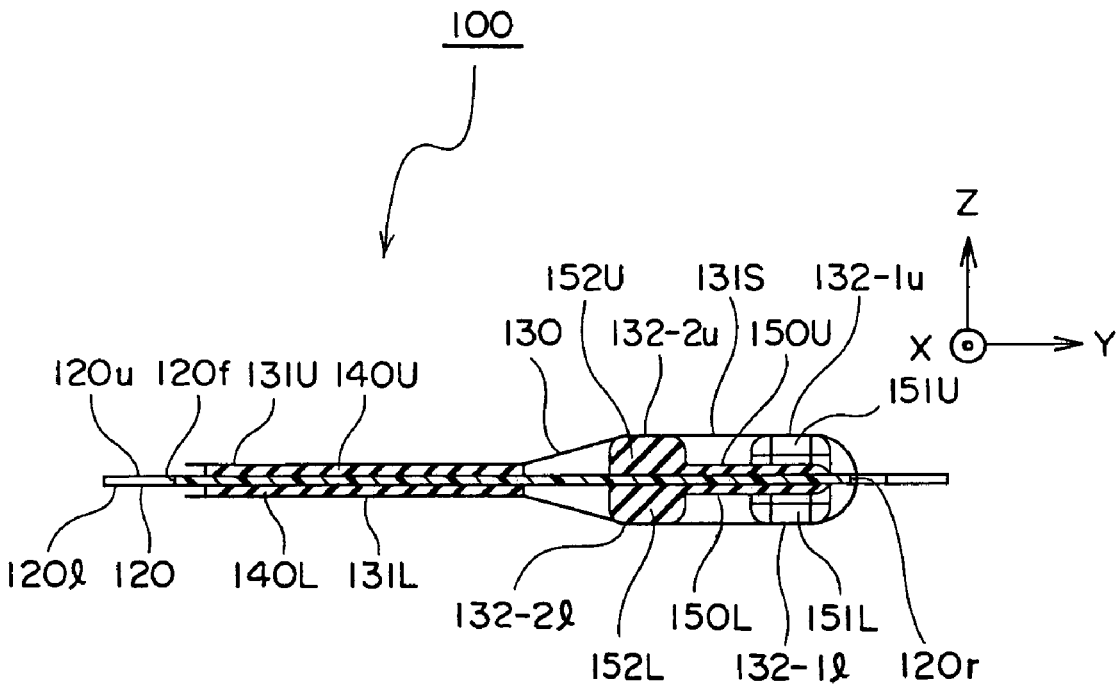
FIG. 3 RELATED ART
FIG. 3 is an enlarged cross-sectional view showing the related electrical connector of FIG. 2, taken along lines III-III.

Referring to FIGS. 1, 2, and 3, description will be at first directed to a related electrical connector 100 in order to facilitate an understanding of the present invention. FIG. 1 is a perspective view of the related electrical connector 100. FIG. 2 is an enlarged perspective view of the related electrical connector 100. FIG. 3 is an enlarged cross-sectional view showing the related electrical connector 100 of FIG. 2, taken along lines III-III.

In the example being illustrated, a coordinate system has a first or X direction extending from side to side or laterally, a second or Y direction extending back and forth, and a third or Z direction extending up and down. The first through the third directions X, Y, and Z are perpendicular to each other. The first or X direction is also called a lateral direction or a width direction. The second or Y direction is also called a back-and-forth direction. The third or Z direction is also called an up-and-down direction or a thickness direction.

The illustrated electrical connector 100 is for use in an inspection device for light inspection of liquid crystal displays (LCDs), charge coupled devices (CCDs), or the like or inspection of integrated circuit (IC) chips. In a case of the LCDs or the CCDs, the inspection device carries out inspection of the LCDs or CCDs by making contact with a flexible printed circuit (FPC) connected thereto. In a case of the IC chips, the inspection device carries out inspection of the IC chips by making contact with a ball grid array (BGA) or a land grid array (LGA).

The electrical connector 100 is adapted to be interposed between first and second connection object boards (not shown) to electrically connect these boards to each other. Therefore, the electrical connector 100 is called an intermediate connector. The electrical connector 100 comprises a plate-like base member 120 having first and second surfaces

120*u* and 120*l* opposite to each other in the thickness direction Z. The first surface 120*u* is called an upper surface while the second surface 120*l* is called a lower surface. The plate-like base member 120 has front and rear edges 120*f* and 120*r* opposite to each other in the back-and-forth direction Y.

The electrical connector 100 comprises a flexible conductive film or sheet 130, first and second double-sided adhesive sheets 140U and 140L for fixing the flexible conductive film 130 to the base member 120. The first double-sided adhesive sheet 140U is called an upper double-sided adhesive sheet while the second double-sided adhesive sheet 140L is called a lower double-sided adhesive sheet.

Figure 4A:
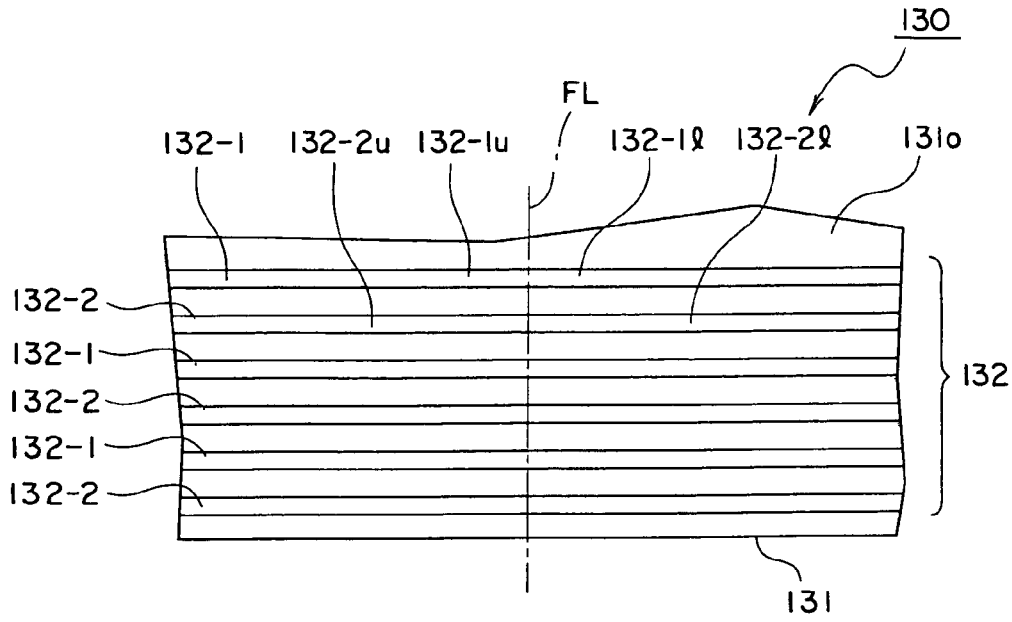
FIG. 4A RELATED ART
FIG. 4A is a fragmentary development of an outer surface of a flexible conductive film for use in the related electrical connector illustrated in FIG. 1.
Figure 4B:
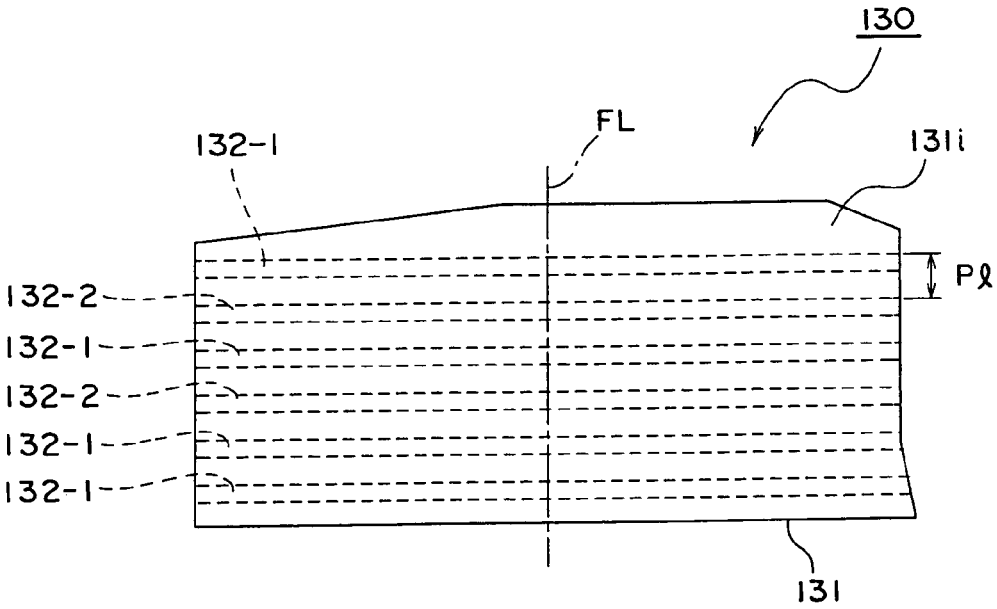
FIG. 4B RELATED ART
FIG. 4B is a fragmentary development of an inner surface of the flexible conductive film illustrated in FIG. 4A.

Specifically, as shown in FIGS. 4A and 4B, the flexible conductive film or sheet 130 comprises a flexible insulating film or sheet 131 and a film conductive pattern 132. The flexible insulating film 131 has an outer surface 131*o* and an inner surface 131*i* opposite to each other. As shown in FIG. 4A, the film conductive pattern 132 is formed on only the outer surface 131*o* of the flexible insulating film 131. The flexible insulating film 131 is folded near the rear edge 120*r* of the plate-like base member 120 along a fold line FL into a generally U shape with the film conductive pattern 132 (or the outer surface 131*o*) kept on the outside so that the film conductive pattern 132 is continued on the outer surface 131*o* of the flexible insulating film 131 in the thickness direction Z. The film conductive pattern 132 consists of a plurality of first and second conductive fine lines 132-1 and 132-2 which are arranged along the lateral direction X. In other words, the first and the second conductive fine lines 132-1 and 132-2 extend in parallel with each other in the back-and-forth direction Y and are spaced from each other in the lateral direction X at a predetermined line pitch PI. The first conductive fine lines 132-1 and the second conductive fine lines 132-2 are alternately arranged along the lateral direction X. Each of the first and the second conductive fine lines 132-1 and 132-2 extends from near the front edge 120*f* of the plate-like base member 120 toward the rear edge 120*r* of the plate-like base member 120 and turns back from near the rear edge 120*r* of the plate-like base member 120 to near the front edge 120*f* of the plate-like base member 120, as shown in FIG. 3.

As shown in FIG. 3, the flexible insulating film 131 has a first or an upper end portion 131U fixed to the first or the upper surface 120*u* of the base member 120 via the first or the upper double-sided adhesive sheet 140U, a second or a lower end portion 131L fixed to the second or the lower surface 120*l* of the base member 120 via the second or the lower double-sided adhesive sheet 140L, and an elastic supporting portion 131S which extends in a generally U shape between the first and the second end portions 131U and 131L and which is spaced from the base member 120.

The electrical connector 100 further comprises first and second elastic members 150U and 150L. The first elastic member 150U is called an upper elastic member while the second elastic member 150L is called a lower elastic member. The first and the second elastic members 150U and 150L are fixed to the first and the second surfaces 120*u* and 120*l* of the base member 120 and are faced to the elastic supporting portion 131S. Therefore, the upper elastic member 150U is interposed between the elastic supporting portion 131S and the upper surface 120*u* of the base member 120 while the lower elastic member 150L is interposed between the elastic supporting portion 131S and the lower surface 120*l* of the base member 120.

As shown in FIG. 2, the upper elastic member 150U has a plurality of first upper protrusions 151U and a plurality of second upper protrusions 152U which jut from the upper elastic member 150U upwards. The first upper protrusions 151U are aligned in a first upper row at near the rear edge 120*r* of the base member 120 along the lateral direction X. The second upper protrusions 152U are aligned in a second upper row apart from the rear edge 120*r* of the base member 120 along the lateral direction X. The first upper row of the first upper protrusions 151U and the second upper row of the second upper protrusions 152U are apart from each other at a predetermined distance in the back-and-forth direction Y. In other words, the first upper protrusions 151U are same with each other in the shape and are arranged at regular intervals in the lateral direction X. The second upper protrusions 152U are same with each other in the shape and are arranged at the regular intervals in the lateral direction X. The regular interval is twice as large as the line pitch PI. That is, the first upper protrusions 151U and the second upper protrusions 151L are arranged so as to shift from each other by the line pitch PI in the lateral direction X. In other words, the first upper protrusions 151U and the second upper protrusions 152U are arranged in a staggered fashion along the lateral direction X.

Likewise, the lower elastic member 150L has a plurality of first lower protrusions 151L and a plurality of second lower protrusions 152L which jut from the lower elastic member 150L downwards. The first lower protrusions 151L are aligned in a first lower row at near the rear edge 120*r* of the base member 120 along the lateral direction X. The second lower protrusions 152L are aligned in a second lower row apart from the rear edge 120*r* of the base member 120 along the lateral direction X. The first lower row of the first lower protrusions 151L and the second lower row of the second lower protrusions 152L are apart from each other at the predetermined distance in the back-and-forth direction Y In other words, the first lower protrusions 151L are same with each other in the shape and are arranged at the regular intervals in the lateral direction X. The second lower protrusions 152L are same with each other in the shape and are arranged at the regular intervals in the lateral direction X. The regular interval is twice as large as the line pitch PI. That is, the first lower protrusions 151L and the second lower protrusions 151L are arranged so as to shift from each other by the line pitch Pi in the lateral direction X. In other words, the first lower protrusions 151L and the second lower protrusions 152L are arranged in the staggered fashion along the lateral direction X.

The first upper protrusions 151U and the first lower protrusions 151L are arranged opposite to each other with the base member 120 sandwiched therebetween, as shown in FIG. 3. The second upper protrusions 152U and the second lower protrusions 152L are arranged opposite to each other with the base member 120 sandwiched therebetween, as shown in FIG. 3. The first upper protrusions 151U and the first lower protrusions 151L are formed at positions faced to the first conductive fine lines 132-1 while the second upper protrusions 152L and the second lower protrusions 152L are formed at positions faced to the second conductive fine lines 132-2, as shown in FIG. 1.

Each of the first conductive fine lines 132-1 has a first upper electrode pad or contact portion 132-1*u* formed above the corresponding first upper protrusion 151U and a first lower electrode pad or contact portion 132-1*l* formed above the corresponding first lower protrusion 151L. Similarly, each of the second conductive fine lines 132-2 has a second upper electrode pad or contact portion 132-2*u* formed above the corresponding second upper protrusion 152U and a second lower electrode pad or contact portion 132-2*l* formed above the corresponding second lower protrusion 152L.

Figure 5:
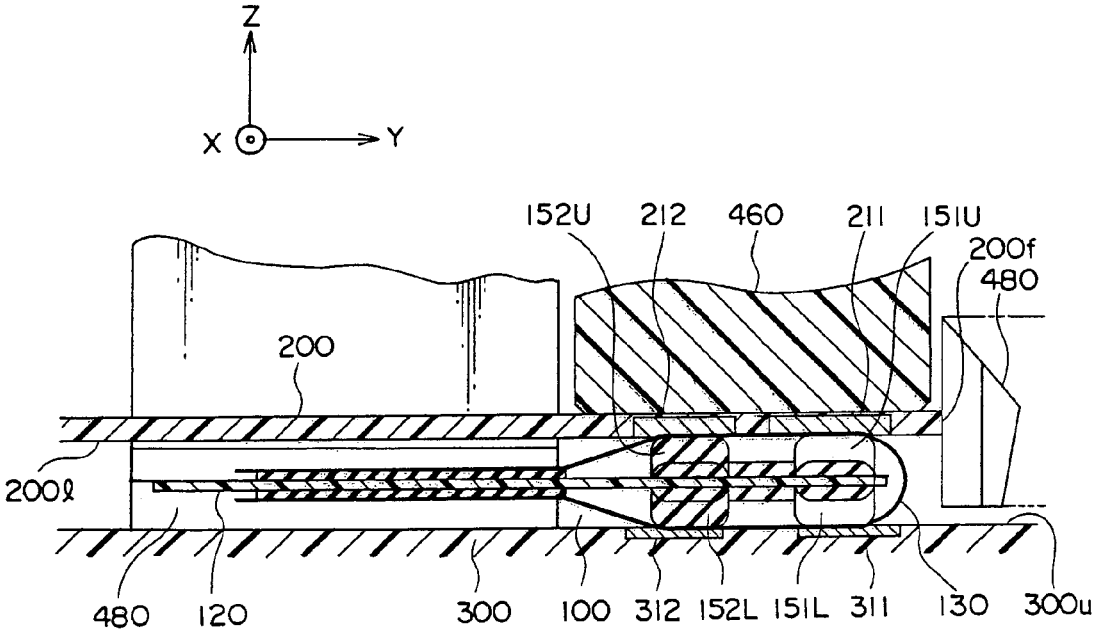
FIG. 5 RELATED ART
FIG. 5 is an enlarged cross-sectional view showing a connected state where the related electrical connector is interposed between a flexible printed circuit and a printed circuit board.
Figure 6:
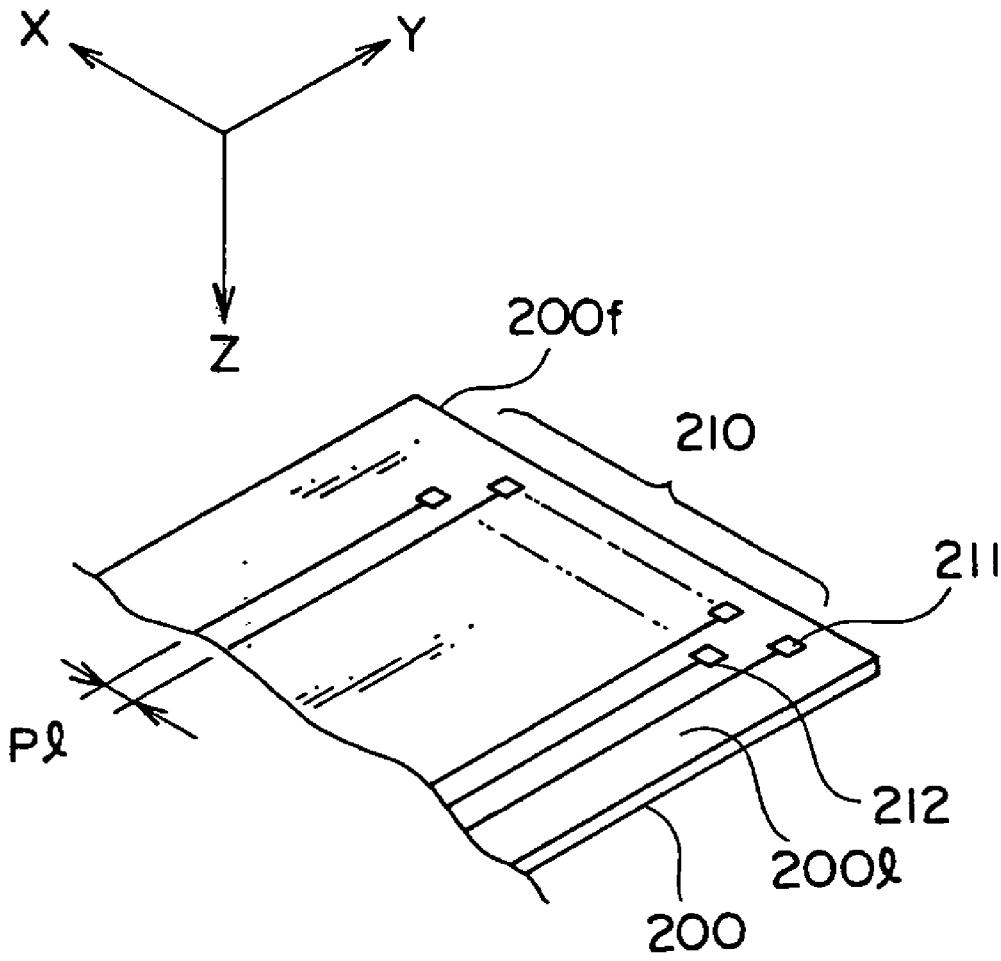
FIG. 6 is a fragmentary perspective view of a portion of the flexible printed circuit.

As shown in FIG. 5, the electrical connector 100 is adapted to be interposed between first and second connection object boards 200 and 300 to electrically connect these boards to each other. In the example being illustrated, the first connection object board 200 is a flexible printed circuit (FPC) while the second connection object board 300 is a printed circuit board. Referring to FIG. 6 in addition to FIG. 5, the flexible printed circuit 200 has a lower surface 200*l* on which a first conductive pattern 210 is formed. The first conductive pattern 210 comprises a plurality of first lower pads or contact portions 211 and a plurality of second lower pads or contact portions 212. The first lower pads 211 are aligned in a first lower row at near a front edge 200*f* of the flexible printed circuit 200 along the lateral direction X. The second lower pads 212 are aligned in a second lower row apart from the front edge 200*f* along the lateral direction X. The first lower pads 211 and the second lower pads 212 are apart from each other at the predetermined distance in the back-and-forth direction Y. In other words, the first lower pads 211 are arranged at regular intervals in the lateral direction X while the second lower pads 212 are arranged at the regular intervals in the lateral direction X. The regular interval is twice as large as the line pitch PI. That is, the first lower pads 211 and the second lower pads 212 are arranged so as to shift from each other by the predetermined distance in the back-and-forth direction Y In other words, the first lower pads 211 and the second lower pads 212 are arranged in a staggered fashion along the lateral direction X.

Figure 7:
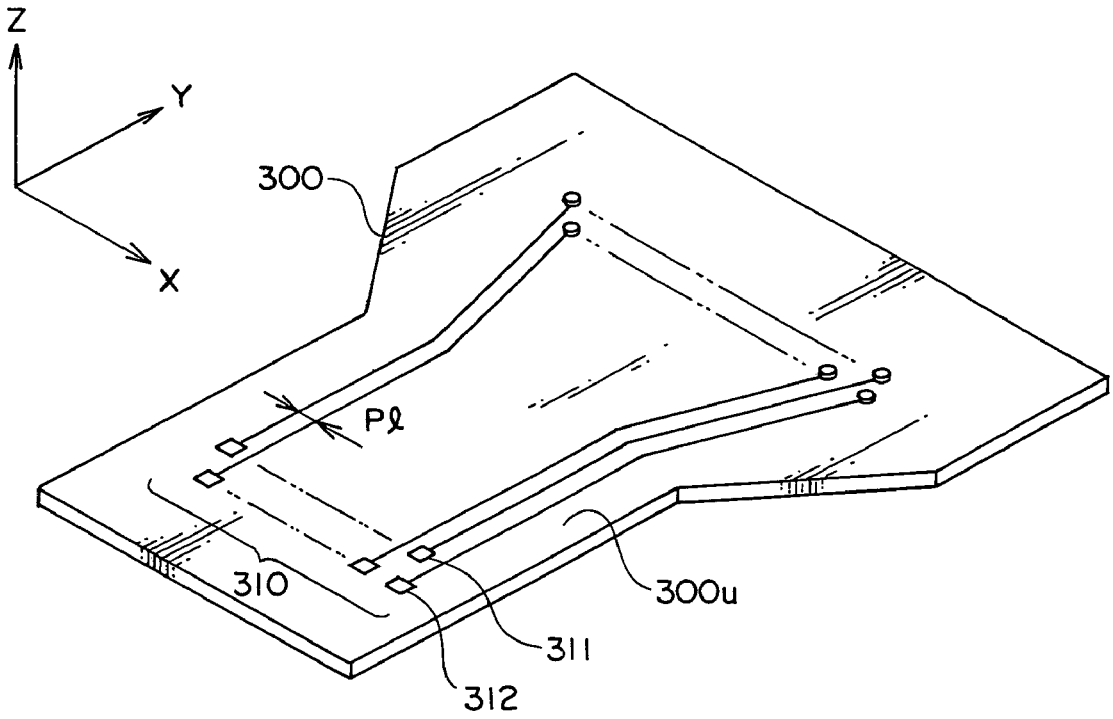
FIG. 7 is a perspective view of the printed circuit board.

Referring to FIG. 7 in addition to FIG. 5, the printed circuit board 300 has an upper surface 300*u* on which a second conductive pattern 310 is formed. The second conductive pattern 310 comprises a plurality of first upper pads or contact portions 311 and a plurality of second upper pads or contact portions 312. The first upper pads 311 are aligned in a first upper row along the lateral direction X. The second upper pads 312 are aligned in a second lower row along the lateral direction X. The first upper pads 311 and the second upper pads 312 are apart from each other at the predetermined distance in the back-and-forth direction Y. In other words, the first upper pads 311 are arranged at regular intervals in the lateral direction X while the second upper pads 312 are arranged at the regular intervals in the lateral direction X. The regular interval is twice as large as the line pitch PI. That is, the first upper pads 311 and the second upper pads 312 are arranged so as to shift from each other by the predetermined distance in the back-and-forth direction Y. In other words, the first upper pads 311 and the second upper pads 312 are arranged in the staggered fashion along the lateral direction X.

In the manner which will later be described by using a connecting tool 400, the first and the second upper electrode pads 132-1*u* and 132-2*u* of the flexible conductive film 130 are electrically connected to the first and the second lower pads 211 and 212 formed on the lower surface 200*l* of the flexible printed circuit 200,respectively, while the first and the second lower electrode pads 132-1*l* and 132-2*l* of the flexible conductive film 130 are electrically connected to the first and the second upper pads 311 and 312 formed on the upper surface 300*u* of the printed circuit board 300, respectively. Therefore, the flexible printed circuit 200 and the printed circuit board 300 are electrically connected to each other through the electrical connector 100.

Figure 8:
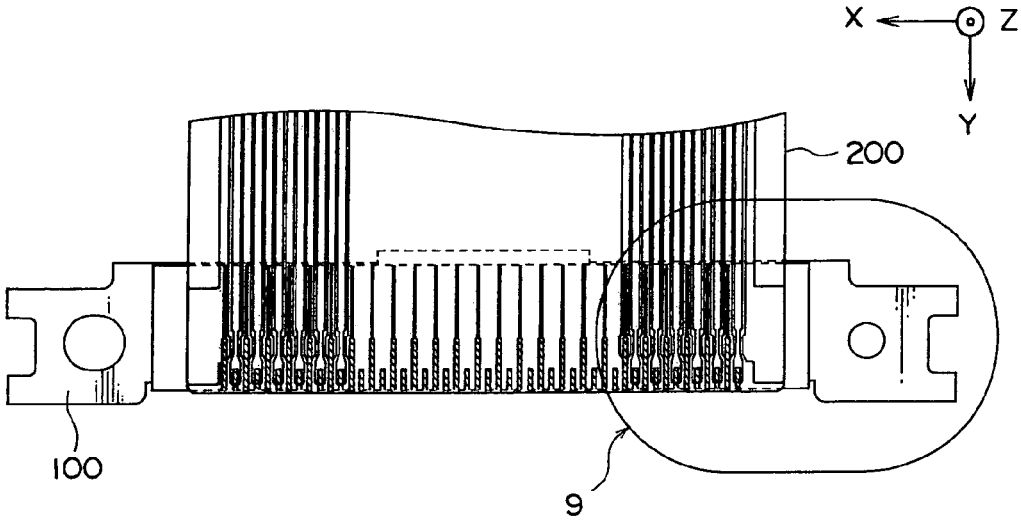
FIG. 8 RELATED ART
FIG. 8 is a plan view showing a connected state between the related electrical connector and the flexible printed circuit.
Figure 9:
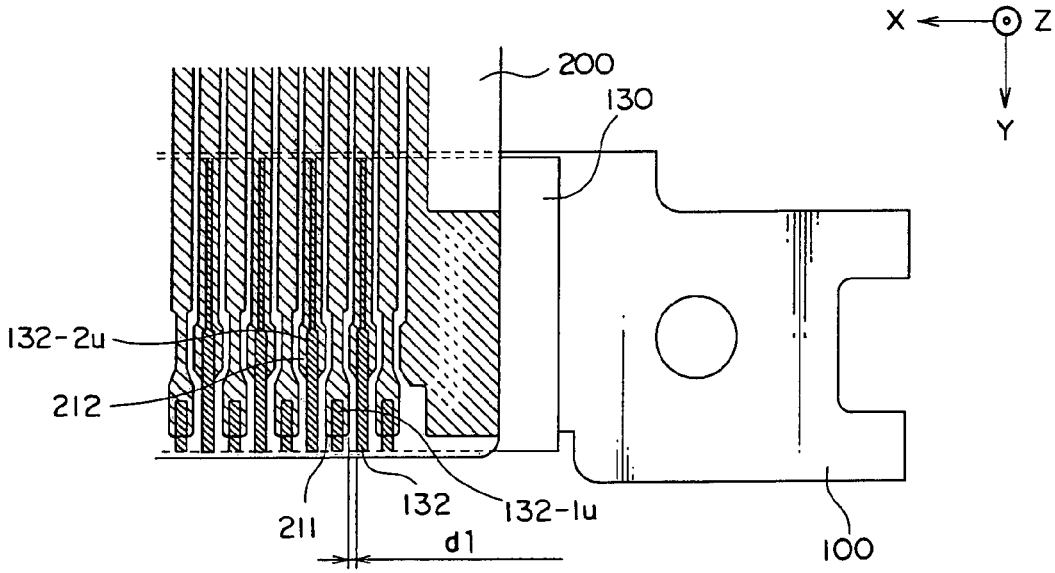
FIG. 9 RELATED ART
FIG. 9 is an enlarged view of the connected state enclosed in an ellipse 9 in FIG. 8.

FIG. 8 is a plan view showing a connected state between the electrical connector 100 and the flexible printed circuit 200. FIG. 9 is an enlarged view of the connected state enclosed in an ellipse 9 in FIG. 8. In the manner which is described above, the first upper electrode pads 132-1*u* of the first conductive fine lines 132-1 of the electrical connector 100 are electrically connected to the first lower pads 211 of the flexible printed circuit 200 while the second upper electrode pads 132-2*u* of the second conductive fine lines 132-2 of the electrical connector 100 are electrically connected to the second lower pads 212 of the flexible printed circuit 200. Inasmuch as the first and the second lower pads 211 and 212 of the flexible printed circuit 200 are arranged in the staggered fashion along the lateral direction X, there is a high possibility of making a short circuit when the conductive pattern 132 of the flexible conductive film 130 is formed only on the outer surface 131*o* of the flexible insulating film 131. This is because a distance d1 between the first conductive pattern 210 of the flexible printed circuit 200 and the film conductive pattern 132 of the electrical connector 100 becomes smaller, as shown in FIG. 9.

Figure 10:
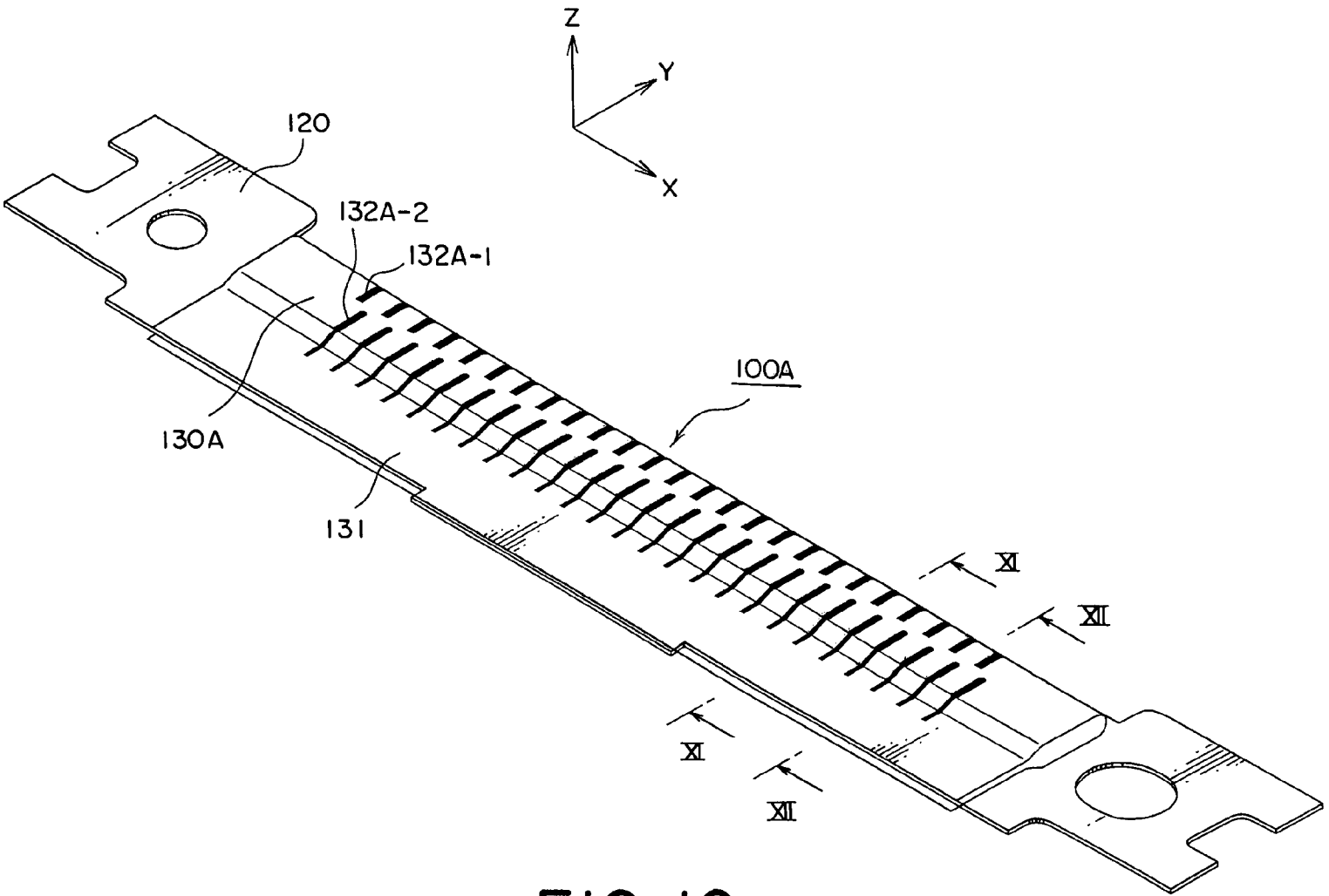
FIG. 10 is a perspective view of an electrical connector according to a first embodiment of this invention.
Figure 11:
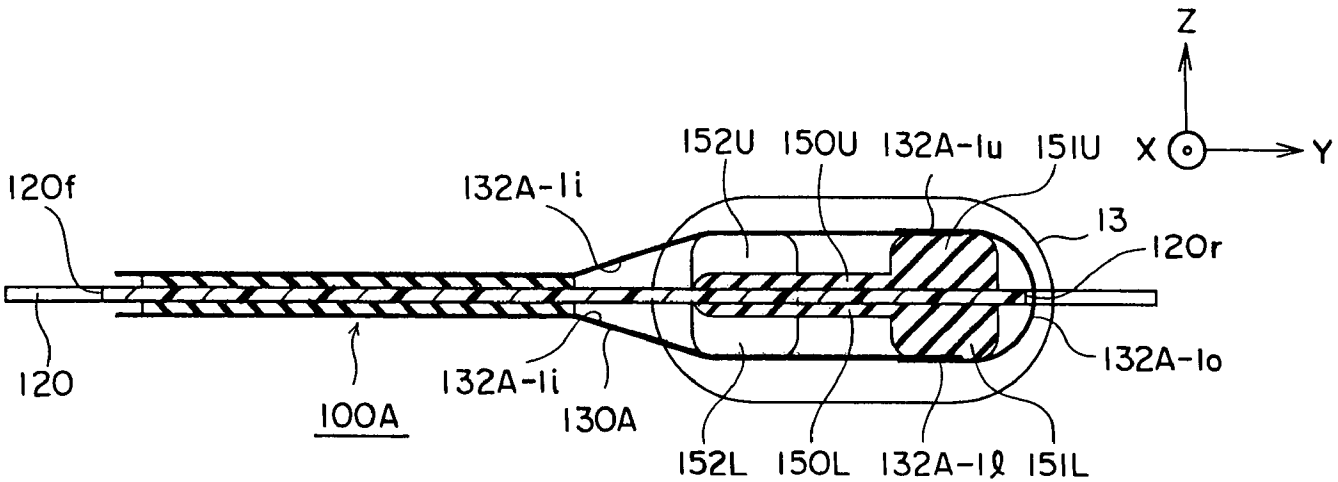
FIG. 11 is a cross sectional view taken on line XI-XI of FIG. 10.
Figure 12:
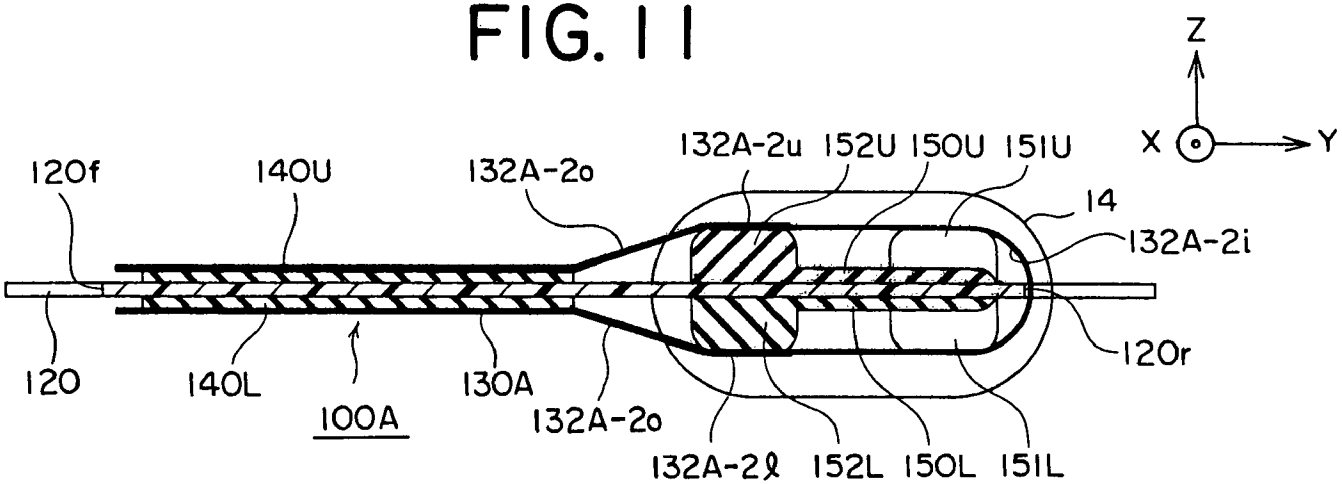
FIG. 12 is a cross sectional view taken on line XII-XII of FIG. 10.
Figure 13:
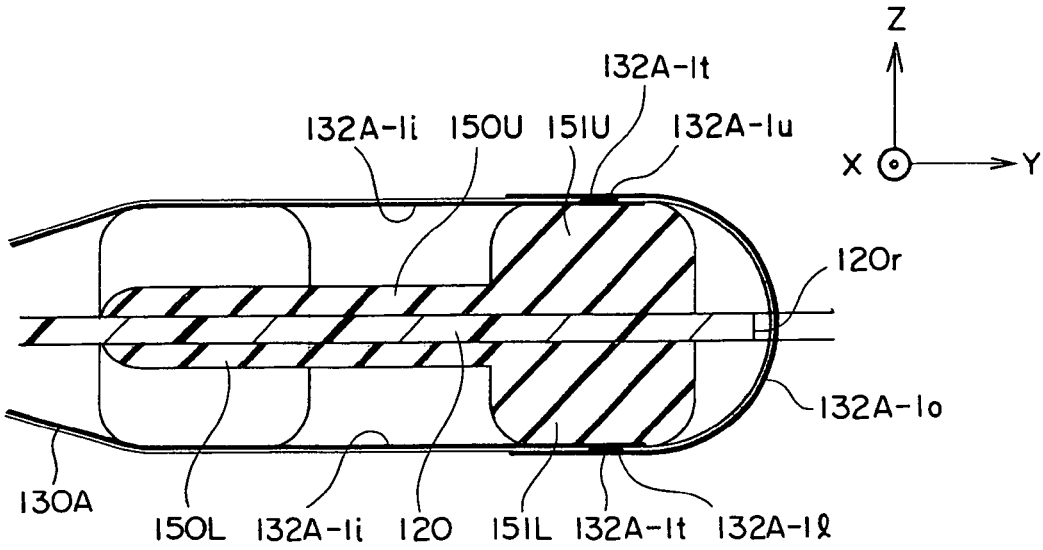
FIG. 13 is an enlarged view of the electrical connector enclosed in an ellipse 13 in FIG. 11.
Figure 14:
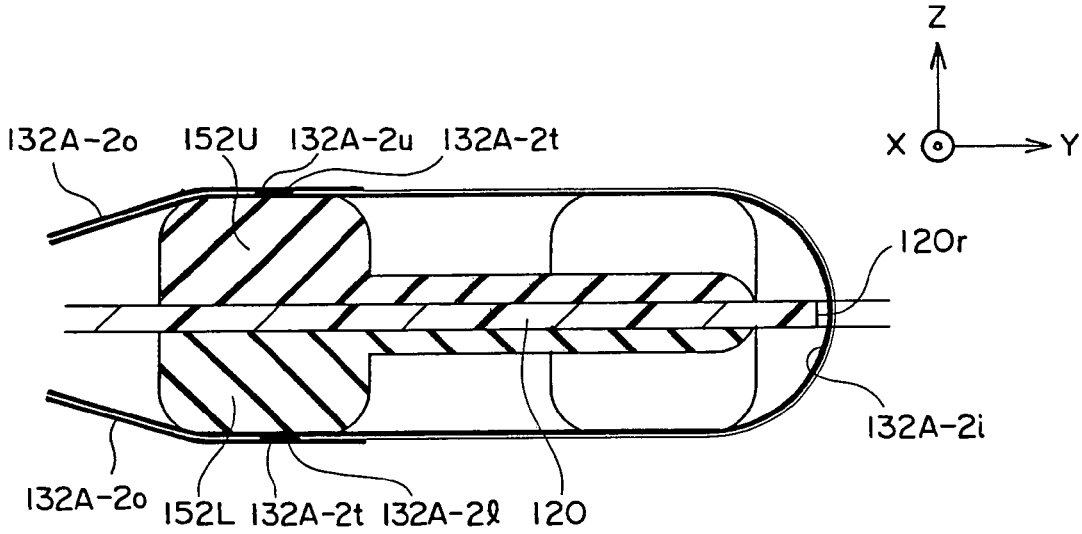
FIG. 14 is an enlarged view of the electrical connector enclosed in an ellipse 14 in FIG. 12.

Referring to FIGS. 10 through 14, the description will proceed to an electrical connector 100A according to a first embodiment of this invention. FIG. 10 is a perspective view of the electrical connector 100A. FIG. 11 is a cross sectional view taken on line XI-XI of FIG. 10. FIG. 12 is a cross sectional view taken on line XII-XII of FIG. 10. FIG. 13 is an enlarged view of the electrical connector 100A enclosed in an ellipse 13 in FIG. 11. FIG. 14 is an enlarged view of the electrical connector 100A enclosed in an ellipse 14 in FIG. 12.

The illustrated electrical connector 100A is similar in structure to that illustrated in FIGS. 1-3 except that the flexible conductive film is modified from that illustrated in FIGS. 1-3 in the manner which will later be described. The flexible conductive film is therefore depicted at a reference symbol of 130A. Similar reference symbols are attached to those similar to the electrical connector 100 in illustrated in FIGS. 1-3 and description thereof is omitted to simplify description.

Figure 15A:
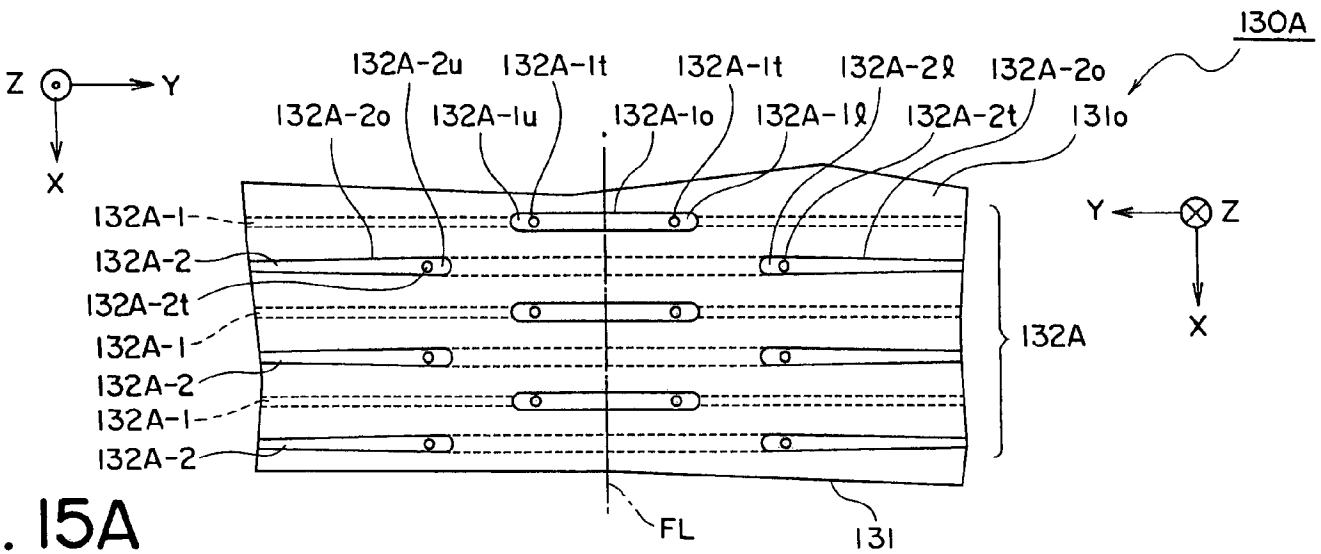
FIG. 15A is a fragmentary development of an outer surface of a flexible conductive film for use in the electrical connector illustrated in FIG. 10.
Figure 15B:
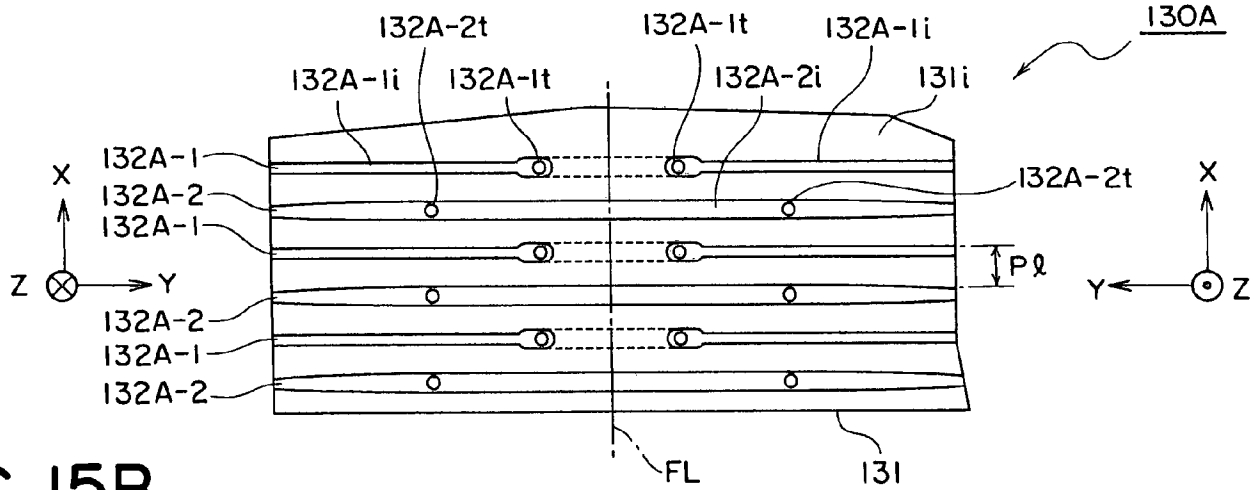
FIG. 15B is a fragmentary development of an inner surface of the flexible conductive film illustrated in FIG. 15A.

As shown in FIGS. 15A and 15B, the flexible conductive film 130A is similar in structure to that illustrated in that illustrated in FIGS. 4A and 4B except that the film conductive pattern is modified from that illustrated in FIGS. 4A and 4B in the manner which will later be described. The film conductive pattern is therefore depicted at a reference symbol of 132A.

In the flexible conductive film 130 of the related electrical connector 100, the film conductive pattern 132 is formed only on the outer surface 131*o* of the flexible insulating film 131, as shown in FIGS. 4A and 4B. On the other hand, in the flexible conductive film 130A of the electrical connector 100A according to this invention, the film conductive pattern 132A is formed not only on the outer surface 131*o* of the flexible insulating film 131 but also on the inner surface 131*i* of the flexible insulating film 131, as shown in FIGS. 15A and 15B.

More specifically, the film conductive pattern 132A consists of a plurality of first and second conductive fine lines 132A-1 and 132A-2 which are arranged along the lateral direction X. In other words, the first and the second conductive fine lines 132A-1 and 132A-2 extend in parallel with each other in the back-and-forth direction Y and are spaced from each other in the lateral direction X at the predetermined line pitch PI. The first conductive fine lines 132A-1 and the second conductive fine lines 132A-2 are alternatively arranged along the lateral direction X. Each of the first and the second conductive fine lines 132A-1 and 132A-2 extends from near the front edge 120*f* of the plate-like base member 120 toward the rear edge 120*r* of the plate-like base member 120 and turns back from near the rear edge 120*r* of the plate-like base member 120 to near the front edge 120*f* of the plate-like base member 120, as shown in FIGS. 11 and 12.

Each of the first conductive fine lines 132A-1 has a first upper electrode pad or contact portion 132A-1*u* formed above the corresponding first upper protrusion 151U and a first lower electrode pad or contact portion 132A-1*l* formed above the corresponding first lower protrusion 151L. The first upper electrode pad 132A-1*u* and the first lower electrode pad 132A-1*l* are formed on the outer surface 131*o* of the flexible insulating film 131.

Each of the first conductive fine lines 132A-1 comprises a first outer conductive line portion 132A-1*o* and a pair of first inner conductive line portions 132A-1*i* The first outer conductive line portion 132A-1*o* is formed on the outer surface 131*o* of the flexible insulating film 131 and is for electrically connecting the first upper electrode pad 132A-1*u* with the first lower electrode pad 132A-1*l*. That is, the first outer conductive line portion 132A-1*o* acts as a first connection member for electrically connecting the first upper electrode pad 132A-1*u* with the first lower electrode pad 132A-1*l*

The pair of first inner conductive line portions 132A-1*i* is formed on the inner surface 131*i* of the flexible insulating film 131. One of the pair of first inner conductive line portions 132A-1*i* is electrically connected to the first upper electrode pad 132A-1*u* via a through hole 132A-1*t* while another of the pair of first inner conductive line portions 132A-1*i* is electrically connected to the first lower electrode pad 132A-1*l*.

Similarly, each of the second conductive fine lines 132A-2 has a second upper electrode pad or contact portion 132A-2*u* formed above the corresponding second upper protrusion 152U and a second lower electrode pad or contact portion 132A-2*l* formed above the corresponding second lower protrusion 152L. The second upper electrode pad 132A-2*u* and the second lower electrode pad 132A-2*l* are formed on the outer surface 131*o* of the flexible insulating film 131.

Each of the second conductive fine lines 132A-2 comprises a second inner conductive line portion 132A-2*i* and a pair of second outer conductive line portions 132A-2*o*. The second inner conductive line portion 132A-2*i* is formed on the inner surface 131*i* of the flexible insulating film 131 and is for electrically connecting the second upper electrode pad 132A-2*u* with the second lower electrode pad 132A-2*l* via through holes 132A-2*t*. That is, a combination of the second inner conductive line portion 132A-2*i* and the through holes 132A-2*t* serves as a second connection member for electrically connecting the second upper electrode pad 132A-2*u* with the second lower electrode pad 132A-2*i*.

The pair of second outer conductive line portions 132A-2*o* is formed on the outer surface 131*o* of the flexible insulating film 131. One of the pair of second outer conductive line portions 132A-2*o* is electrically connected to the second upper electrode pad 132A-2*u* while another of the pair of second outer conductive line portions 132A-2*o* is electrically connected to the second lower electrode pad 132A-2*l*.

At any rate, the film conductive pattern 132A is formed not only on the outer surface 131*o* of the flexible insulating film 131 but also on the inner surface 131*i* of the flexible insulating film 131.

Figure 16:
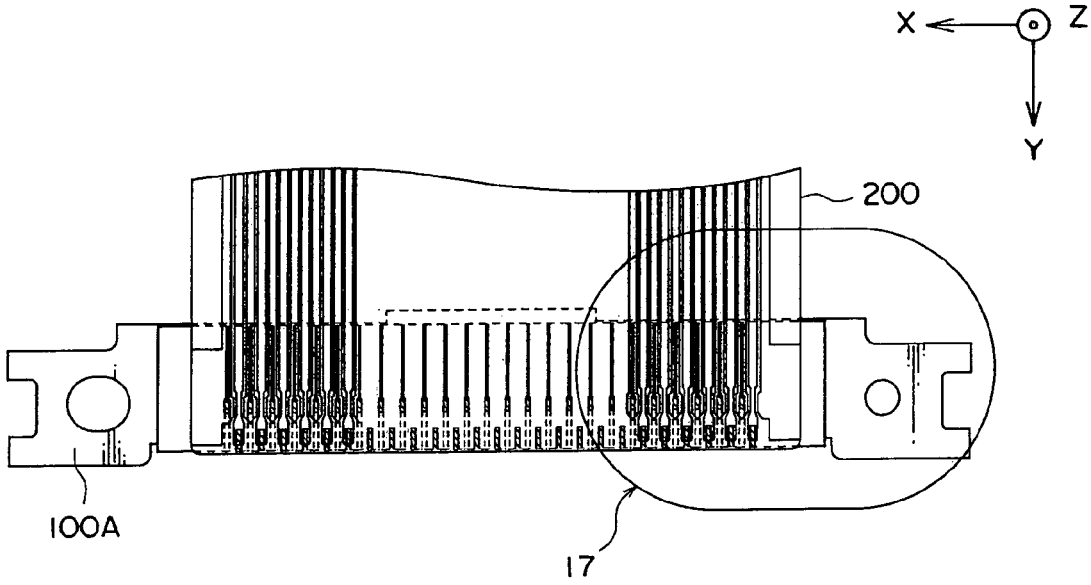
FIG. 16 is a plan view showing a connected state between the electrical connector and the flexible printed circuit.
Figure 17:
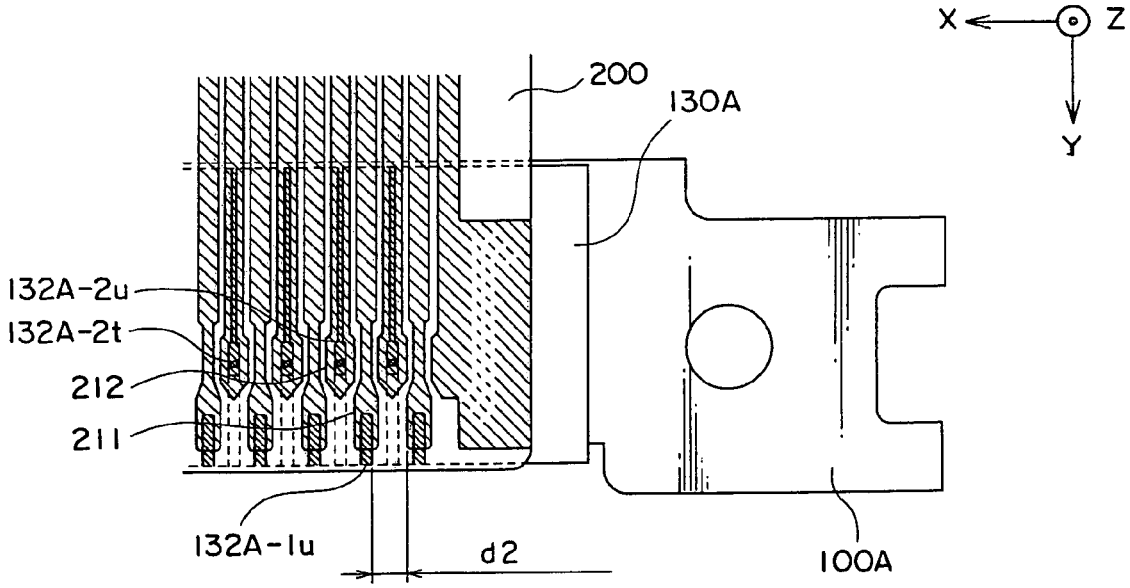
FIG. 17 is an enlarged view of the connected state enclosed in an ellipse 17 in FIG. 16.

FIG. 16 is a plan view showing a connected state between the electrical connector 100A and the flexible printed circuit 200. FIG. 17 is an enlarged view of the connected state enclosed in an ellipse 17 in FIG. 16. The first upper electrode pads 132A-1*u* of the first conductive fine lines 132A-1 of the electrical connector 100A are electrically connected to the first lower pads 211 of the flexible printed circuit 200. The second upper electrode pads 132A-2*u* of the second conductive fine lines 132A-2 of the electrical connector 100A are electrically connected to the second lower pads 212 of the flexible printed circuit 200. In spite of the fact that the first and the second lower pads 211 and 212 of the flexible printed circuit 200 are arranged in the staggered fashion along the lateral direction X, it is possible to prevent the electrical connector 100A from making a short circuit when the film conductive pattern 132A of the flexible conductive film 130A is formed not only on the outer surface 131*o* of the flexible insulating film 131 but also the inner surface 131*i* of the flexible insulating film 131 via the through holes 132A-1*t* and 132A-2*t* or the like. This is because a distance d2 between the first conductive pattern 210 of the flexible printed circuit 200 and the film conductive pattern 132A of the electrical connector 100A becomes larger, as shown in FIG. 17.

Figure 18A:
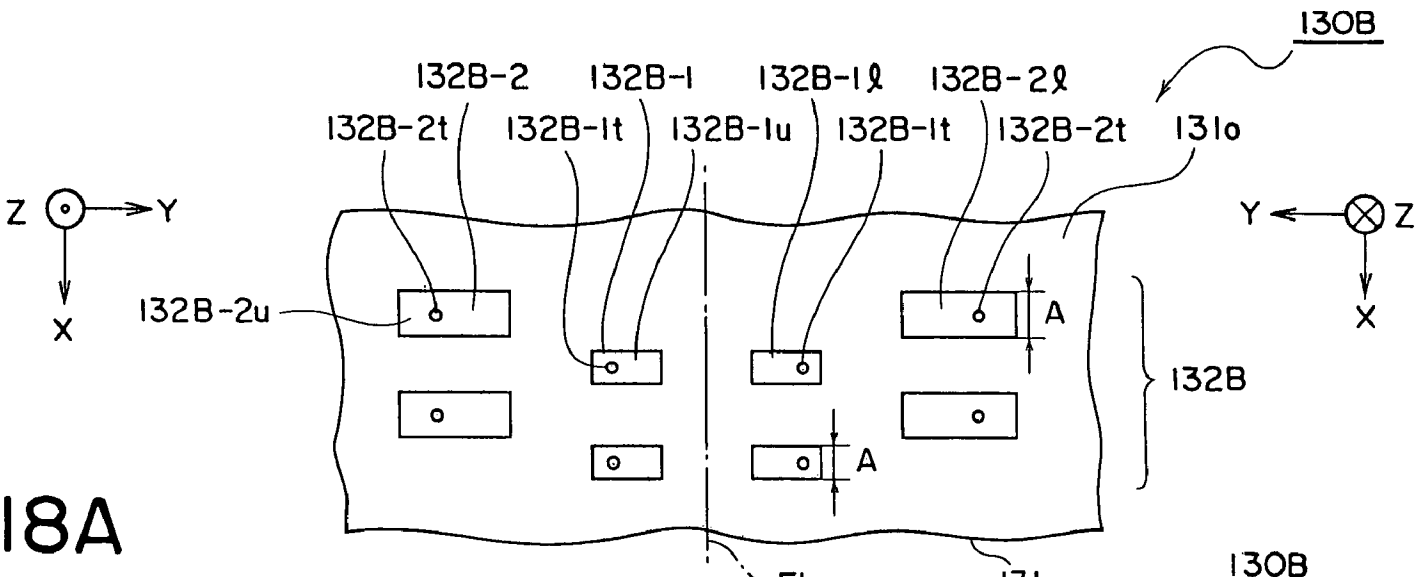
FIG. 18A is a fragmentary development of an outer surface of a flexible conductive film for use in an electrical connector according to a second embodiment of this invention.
Figure 18B:
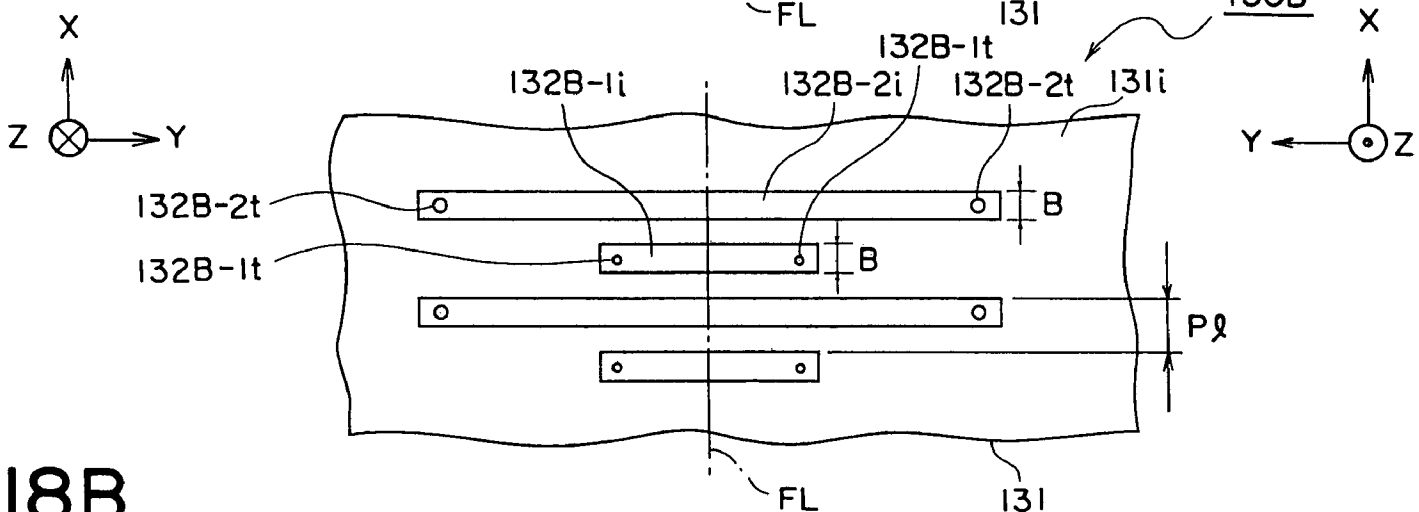
FIG. 18B is a fragmentary development of an inner surface of the flexible conductive film illustrated in FIG. 18A.

Referring to FIGS. 18A and 18B, the description will proceed to an electrical connector according to a second embodiment of this invention. The electrical connector according to the second embodiment of this invention is similar in structure to that illustrated in FIGS. 10-14 except that the flexible conductive film is modified from that illustrated in FIGS. 15A and 15B in the manner which will later be described. The flexible conductive film is therefore depicted at a reference symbol of 130B. Similar reference symbols are attached to those similar to the electrical connector 100A in illustrated in FIGS. 10-14 and description thereof is omitted to simplify description.

As shown in FIGS. 18A and 18B, the flexible conductive film 130B is similar in structure to that illustrated in that illustrated in FIGS. 15A and 15B except that the film conductive pattern is modified from that illustrated in FIGS. 15A and 15B in the manner which will later be described. The film conductive pattern is therefore depicted at a reference symbol of 132B.

In the flexible conductive film 130B of the electrical connector according to the second embodiment of this invention, the film conductive pattern 132B is formed not only on the outer surface 131*o* but also on the inner surface 131*i* of the flexible insulating film 131, as shown in FIGS. 18A and 18B.

More specifically, the film conductive pattern 132B consists of a plurality of first and second conductive fine lines 132B-1 and 132B-2 which are arranged along the lateral direction X. In other words, the first and the second conductive fine lines 132B-1 and 132B-2 extend in parallel with each other in the back-and-forth direction Y and are spaced from each other in the lateral direction X at the predetermined line pitch PI. The first conductive fine lines 132B-1 and the second conductive fine lines 132B-2 are alternatively arranged along the lateral direction X.

Each of the first conductive fine lines 132B-1 has a first upper electrode pad or contact portion 132B-1*u* formed above the corresponding first upper protrusion 151U and a first lower electrode pad or contact portion 132B-1*l* formed above the corresponding first lower protrusion 151L. The first upper electrode pad 132B-1*u* and the first lower electrode pad 132B-1*l* are formed on the outer surface 131*o* of the flexible insulating film 131.

Each of the first conductive fine lines 132B-1 comprises a first inner conductive line portion 132B-1*i* formed on the inner surface 131*i* of the flexible insulating film 131. The first inner conductive line portion 132B-1*i* is for electrically connecting the first upper electrode pad 132B-1*u* with the first lower electrode pad 132B-1*l* via first through holes 132B-1*t*. That is, a combination of the first inner conductive line portion 132B-1*i* and the first through holes 132B-1*t* acts as a first connection member for electrically connecting the first upper electrode pad 132B-1*u* with the first lower electrode pat 132B-1*l*. Each of the first upper electrode pad 132B-1*u* and the fires lower electrode pad 132B-1*l* has a width A which is wider than a width B of the first inner conductive line portion 132B-1*i*.

Similarly, each of the second conductive fine lines 132B-2 has a second upper electrode pad or contact portion 132B-2*u* formed above the corresponding second upper protrusion 152U and a second lower electrode pad or contact portion 132B-2*l* formed above the corresponding second lower protrusion 152L. The second upper electrode pad 132B-2*u* and the second lower electrode pad 132B-2*l* are formed on the outer surface 131*o* of the flexible insulating film 131.

Each of the second conductive fine lines 132B-2 comprises a second inner conductive line portion 132B-2*i*. The second inner conductive line portion 132B-2*i* is formed on the inner surface 131*i* of the flexible insulating film 131 and is for electrically connecting the second upper electrode pad 132B-2*u* with the second lower electrode pad 132B-2*l* via second through holes 132B-2*t*. That is, a combination of the second inner conductive line portion 132B-2*i* and the second through holes 132B-2*t* serves as a second connection member for electrically connecting the second upper electrode pad 132B-2*u* with the second lower electrode pad 132B-2*l*. Each of the second upper electrode pad 132B-2*u* and the second lower electrode pad 132B-2*l* has the width A which is wider than the width B of the second inner conductive line portion 132B-2*i*.

At any rate, the film conductive pattern 132B is formed not only on the outer surface 131*o* of the flexible insulating film 131 but also on the inner surface 131*i* of the flexible insulating film 131.

Figure 19A:
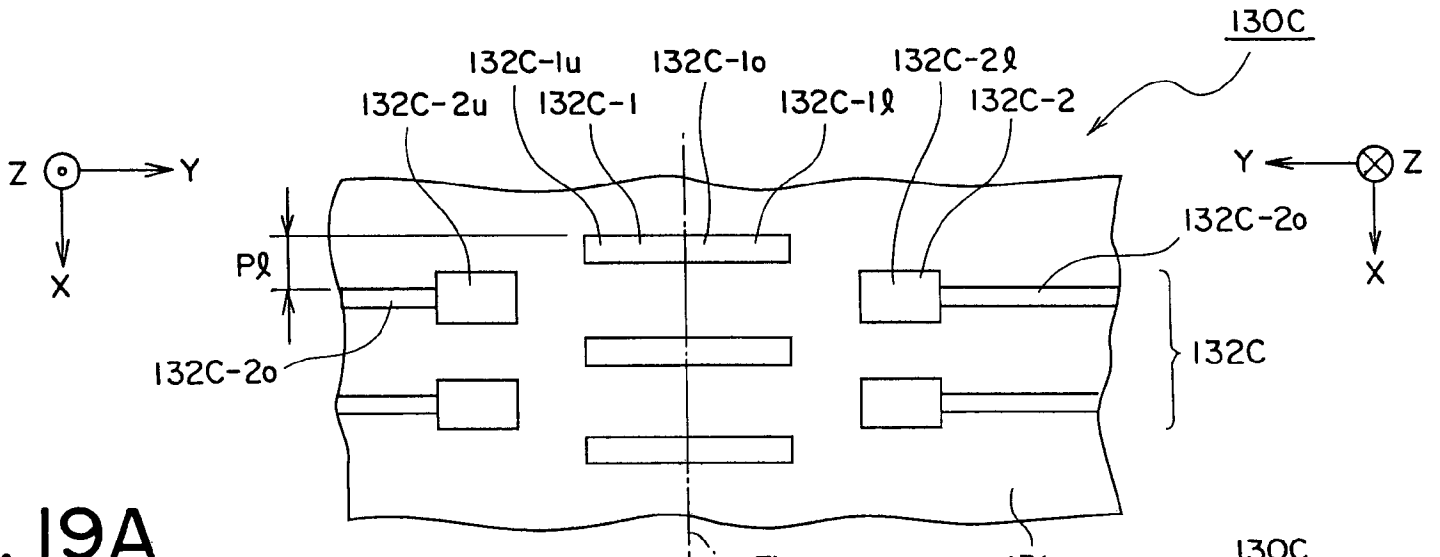
FIG. 19A is a fragmentary development of an outer surface of a flexible conductive film for use in an electrical connector according to a third embodiment of this invention.
Figure 19B:
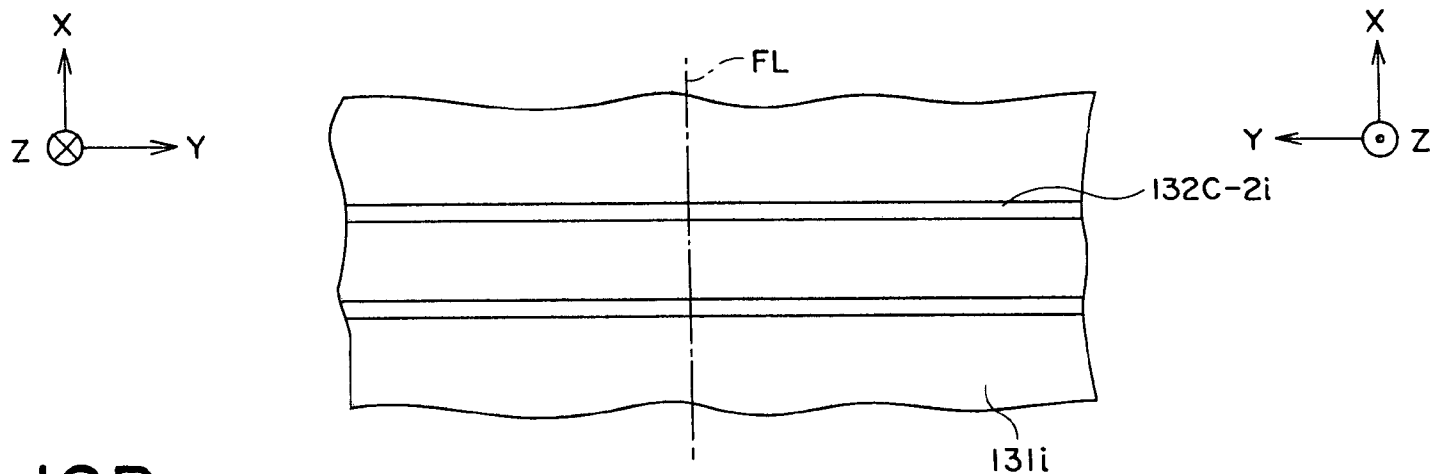
FIG. 19B is a fragmentary development of an inner surface of the flexible conductive film illustrated in FIG. 19A.

Referring to FIGS. 19A and 19B, the description will proceed to an electrical connector according to a third embodiment of this invention. The electrical connector according to the third embodiment of this invention is similar in structure to that illustrated in FIGS. 10-14 except that the flexible conductive film is modified from that illustrated in FIGS. 15A and 15B in the manner which will later be described. The flexible conductive film is therefore depicted at a reference symbol of 130C. Similar reference symbols are attached to those similar to the electrical connector 100A in illustrated in FIGS. 10-14 and description thereof is omitted to simplify description.

As shown in FIGS. 19A and 19A, the flexible conductive film 130C is similar in structure to that illustrated in that illustrated in FIGS. 15A and 15B except that the film conductive pattern is modified from that illustrated in FIGS. 15A and 15B in the manner which will later be described. The film conductive pattern is therefore depicted at a reference symbol of 132C.

More specifically, the film conductive pattern 132C consists of a plurality of first and second conductive fine lines 132C-1 and 132C-2 which are arranged along the lateral direction X. In other words, the first and the second conductive fine lines 132C-1 and 132C-2 extend in parallel with each other in the back-and-forth direction Y and are spaced from each other in the lateral direction X at the predetermined line pitch PI. The first conductive fine lines 132C-1 and the second conductive fine lines 132C-2 are alternatively arranged along the lateral direction X. Each of the second conductive fine lines 132C-2 extends from near the front edge 120*f* of the plate-like base member 120 toward the rear edge 120*r* of the plate-like base member 120 and turns back from near the rear edge 120*r* of the plate-like base member 120 to near the front edge 120*f* of the plate-like base member 120, like FIGS. 11 and 12.

Each of the first conductive fine lines 132C-1 has a first upper electrode pad or contact portion 132C-1*u* formed above the corresponding first upper protrusion 151U and a first lower electrode pad or contact portion 132C-1*l* formed above the corresponding first lower protrusion 151L. The first upper electrode pad 132A-1*u* and the first lower electrode pad 132A-1*l* are formed on the outer surface 131*o* of the flexible insulating film 131. Each of the first conductive fine lines 132C-1 comprises a first outer conductive line portion 132C-1*o*. The first outer conductive line portion 132C-1*o* is formed on the outer surface 131*o* of the flexible insulating film 131 and is for electrically connecting the first upper electrode pad 132C-1*u* with the first lower electrode pad 132C-1*l*. That is, the first outer conductive line portion 132C-1*o* acts as a first connection member for electrically connecting the first upper electrode pad 132C-1*u* with the first lower electrode pad 132C-1*l*.

Similarly, each of the second conductive fine lines 132C-2 has a second upper electrode pad or contact portion 132C-2*u* formed above the corresponding second upper protrusion 152U and a second lower electrode pad or contact portion 132C-2*l* formed above the corresponding second lower protrusion 152L. The second upper electrode pad 132C-2*u* and the second lower electrode pad 132C-2*l* are formed on the outer surface 131*o* of the flexible insulating film 131.

Each of the second conductive fine lines 132C-2 comprises an inner conductive line portion 132C-2*i* and a pair of second outer conductive line portions 132C-2*o*. The inner conductive line portion 132C-2*i* is formed on the inner surface 131*i* of the flexible insulating film 131. The pair of second outer conductive line portions 132C-2*o* is formed on the outer surface 131*o* of the flexible insulating film 131. The inner conductive line portion 132C-2*i* is electrically connected to the pair of second outer conductive line portions 132C-2*o* at both side ends of the flexible insulating film 131 near the front edge 120*f* of the plate-like base member 120. Accordingly, a combination of the inner conductive line portion 132C-2*i* and the pair of second outer conductive line portions 132C-2*o* serves as a second connection member for electrically connecting the second upper electrode pad 132C-2*u* with the second lower electrode pad 132C-2*l*.

At any rate, the film conductive pattern 132C is formed not only on the outer surface 131*o* of the flexible insulating film 131 but also on the inner surface 131*i* of the flexible insulating film 131.

Figure 20A:
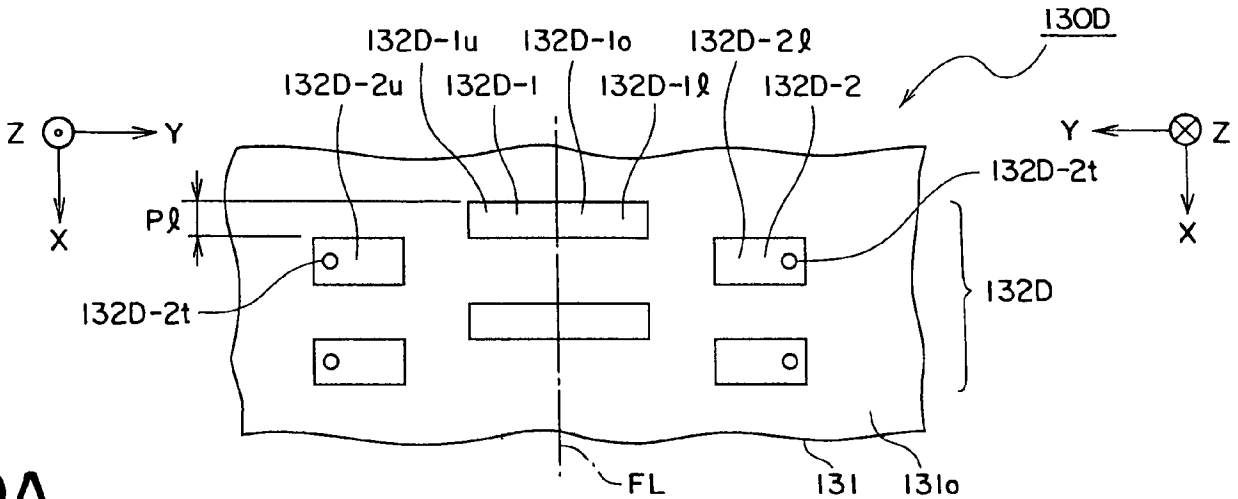
FIG. 20A is a fragmentary development of an outer surface of a flexible conductive film for use in an electrical connector according to a fourth embodiment of this invention.
Figure 20B:
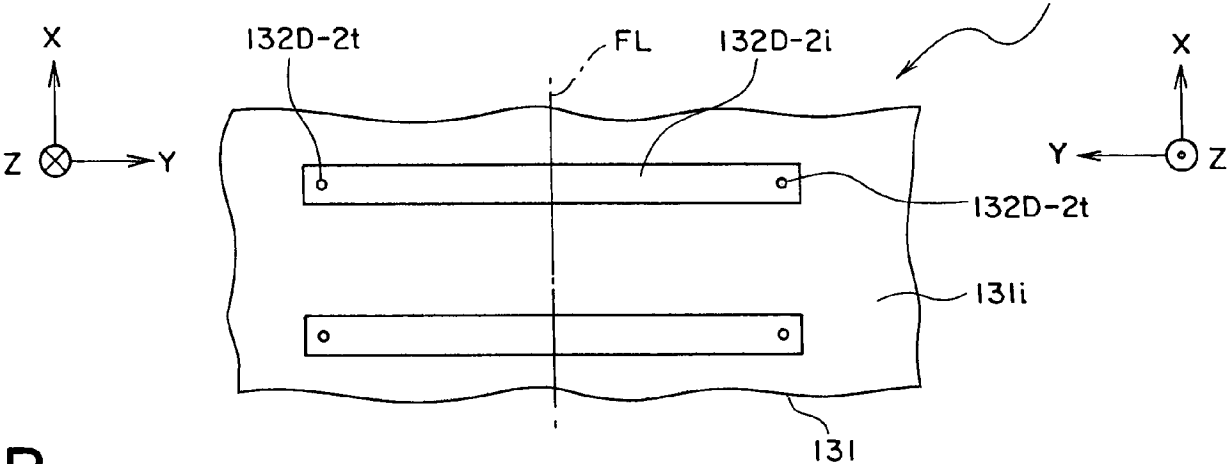
FIG. 20B is a fragmentary development of an inner surface of the flexible conductive film illustrated in FIG. 20A.

Referring to FIGS. 20A and 20B, the description will proceed to an electrical connector according to a fourth embodiment of this invention. The electrical connector according to the fourth embodiment of this invention is similar in structure to that illustrated in FIGS. 10-14 except that the flexible conductive film is modified from that illustrated in FIGS. 15A and 15B in the manner which will later be described. The flexible conductive film is therefore depicted at a reference symbol of 130D. Similar reference symbols are attached to those similar to the electrical connector 100A in illustrated in FIGS. 10-14 and description thereof is omitted to simplify description.

As shown in FIGS. 20A and 20B, the flexible conductive film 130D is similar in structure to that illustrated in that illustrated in FIGS. 15A and 15B except that the film conductive pattern is modified from that illustrated in FIGS. 15A and 15B in the manner which will later be described. The film conductive pattern is therefore depicted at a reference symbol of 132D.

More specifically, the film conductive pattern 132D consists of a plurality of first and second conductive fine lines 132D-1 and 132D-2 which are arranged along the lateral direction X. In other words, the first and the second conductive fine lines 132D-1 and 132D-2 extend in parallel with each other in the back-and-forth direction Y and are spaced from each other in the lateral direction X at the predetermined line pitch PI. The first conductive fine lines 132D-1 and the second conductive fine lines 132D-2 are alternatively arranged along the lateral direction X.

Each of the first conductive fine lines 132D-1 has a first upper electrode pad or contact portion 132D-1*u* formed above the corresponding first upper protrusion 151U and a first lower electrode pad or contact portion 132D-1*l* formed above the corresponding first lower protrusion 151L. The first upper electrode pad 132D-1*u* and the first lower electrode pad 132D-1*l* are formed on the outer surface 131*o* of the flexible insulating film 131. Each of the first conductive fine lines 132D-1 comprises an outer conductive line portion 132D-1*o*. The outer conductive line portion 132D-1*o* is formed on the outer surface 131*o* of the flexible insulating film 131 and is for electrically connecting the first upper electrode pad 132D-1*u* with the first lower electrode pad 132D-1*l*. That is, the outer conductive line portion 132D-1*o* acts as a first connection member for electrically connecting the first upper pad 132D-1*u* with the first lower electrode pad 132D-1*l*.

Similarly, each of the second conductive fine lines 132D-2 has a second upper electrode pad or contact portion 132D-2*u* formed above the corresponding second upper protrusion 152U and a second lower electrode pad or contact portion 132D-2*l* formed above the corresponding second lower protrusion 152L. The second upper electrode pad 132D-2*u* and the second lower electrode pad 132D-2*l* are formed on the outer surface 131*o* of the flexible insulating film 131. Each of the second conductive fine lines 132D-2 comprises an inner conductive line portion 132D-2*i*. The inner conductive line portion 132D-2*i* is formed on the inner surface 131*i* of the flexible insulating film 131 and is for electrically connecting the second upper electrode pad 132D-2*u* with the second lower electrode pad 132D-2*l* via through holes 132D-2*t*. That is, a combination of the inner conductive line portion 132D-2*i* and the through holes 132D-2*t* serves as a second connection member for electrically connecting the second upper electrode pad 132D-2*u* with the second lower electrode pad 132D-2*l*.

At any rate, the film conductive pattern 132D is formed not only on the outer surface 131*o* of the flexible insulating film 131 but also on the inner surface 131*i* of the flexible insulating film 131.

Figure 21A:
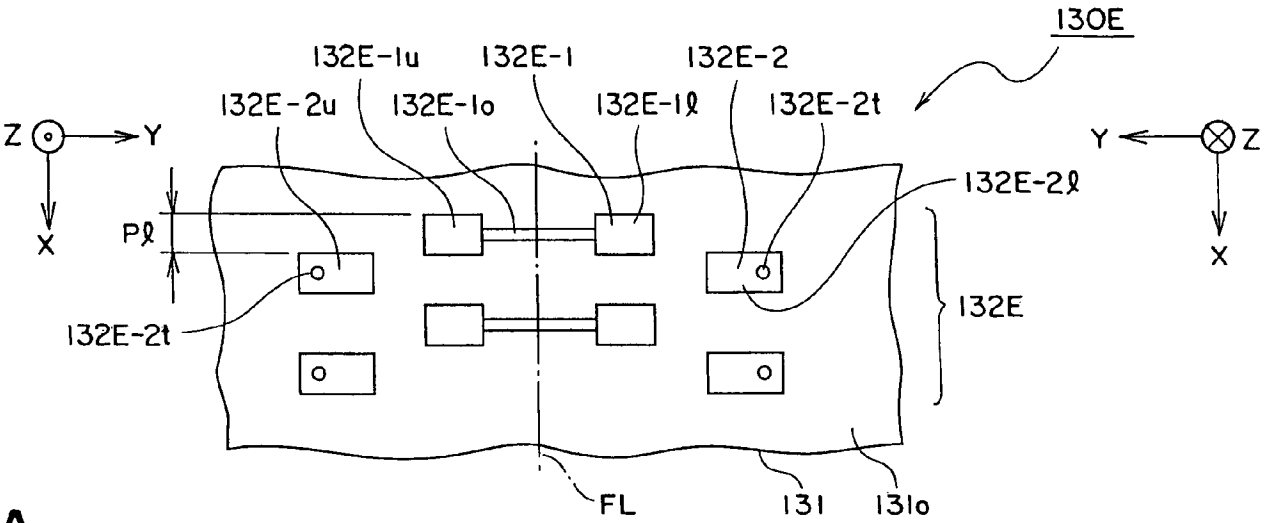
FIG. 21A is a fragmentary development of an outer surface of a flexible conductive film for use in an electrical connector according to a fifth embodiment of this invention.
Figure 21B:
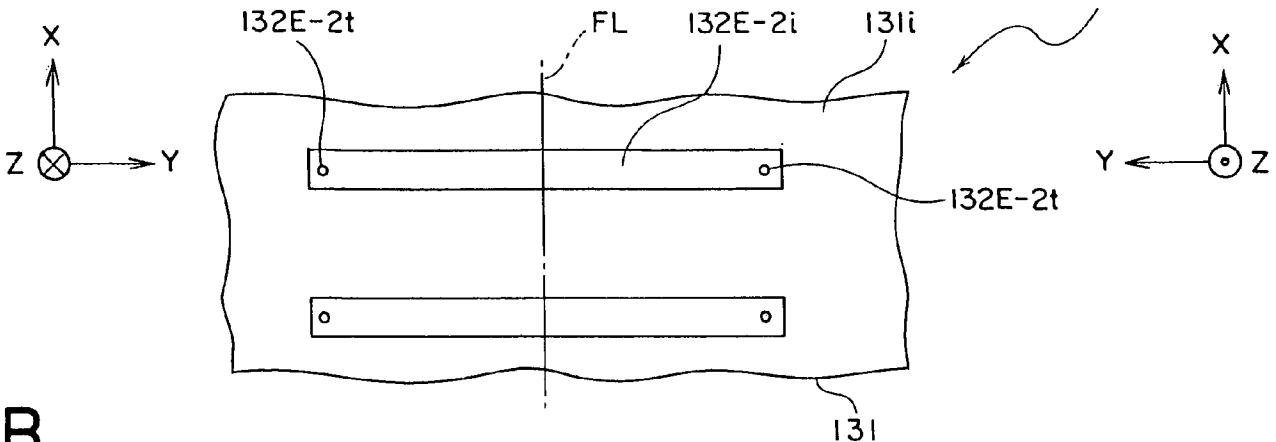
FIG. 21B is a fragmentary development of an inner surface of the flexible conductive film illustrated in FIG. 21A.

Referring to FIGS. 21A and 21B, the description will proceed to an electrical connector according to a fifth embodiment of this invention. The electrical connector according to the fifth embodiment of this invention is similar in structure to that illustrated in FIGS. 10-14 except that the flexible conductive film is modified from that illustrated in FIGS. 15A and 15B in the manner which will later be described. The flexible conductive film is therefore depicted at a reference symbol of 130E. Similar reference symbols are attached to those similar to the electrical connector 100A in illustrated in FIGS. 10-14 and description thereof is omitted to simplify description.

As shown in FIGS. 21A and 21B, the flexible conductive film 130E is similar in structure to that illustrated in that illustrated in FIGS. 15A and 15B except that the film conductive pattern is modified from that illustrated in FIGS. 15A and 15B in the manner which will later be described. The film conductive pattern is therefore depicted at a reference symbol of 132E.

More specifically, the conductive pattern 132E consists of a plurality of first and second conductive fine lines 132E-1 and 132E-2 which are arranged along the lateral direction X. In other words, the first and the second conductive fine lines 132E-1 and 132E-2 extend in parallel with each other in the back-and-forth direction Y and are spaced from each other in the lateral direction X at the predetermined line pitch PI. The first conductive fine lines 132E-1 and the second conductive fine lines 132E-2 are alternatively arranged along the lateral direction X.

Each of the first conductive fine lines 132E-1 has a first upper electrode pad or contact portion 132E-1*u* formed above the corresponding first upper protrusion 151U and a first lower electrode pad or contact portion 132E-1*l* formed above the corresponding first lower protrusion 151L. The first upper electrode pad 132E-1*u* and the first lower electrode pad 132E-1*l* are formed on the outer surface 131*o* of the flexible insulating film 131. Each of the first conductive fine lines 132E-1 comprises an outer conductive line portion 132E-1*o*. The outer conductive line portion 132E-1*o* is formed on the outer surface 131*o* of the flexible insulating film 131 and is for electrically connecting the first upper electrode pad 132E-1*u* with the first lower electrode pad 132E-1*l*. That is, the outer conductive line portion 132E-1*o* acts as a first connection member for electrically connecting the first upper electrode pad 132E-1*u* with the first lower electrode pad 132E-1*l*. The outer conductive line portion 132E-1*o* has a width which is narrower than that of each of the first upper electrode pad 132E-1*u* and the first lower electrode pad 132E-1*i*.

Similarly, each of the second conductive fine lines 132E-2 has a second upper electrode pad or contact portion 132E-2*u* formed above the corresponding second upper protrusion 152U and a second lower electrode pad or contact portion 132E-2*l* formed above the corresponding second lower protrusion 152L. The second upper electrode pad 132E-2*u* and the second lower electrode pad 132E-2*l* are formed on the outer surface 131*o* of the flexible insulating film 131. Each of the second conductive fine lines 132E-2 comprises an inner conductive line portion 132E-2*i*. The inner conductive line portion 132E-2*i* is formed on the inner surface 131*i* of the flexible insulating film 131 and is for electrically connecting the second upper electrode pad 132E-2*u* with the second lower electrode pad 132E-2*l* via through holes 132E-2*t*. That is, a combination of the inner conductive line portion 132E-2*i* and the through holes 132E-2*t* serves as a second connection member for electrically connecting the second upper electrode pad 132E-2*u* with the second lower electrode pad 132E-2*l*.

At any rate, the film conductive pattern 132E is formed not only on the outer surface 131*o* of the flexible insulating film 131 but also on the inner surface 131*i* of the flexible insulating film 131.

Figure 22:
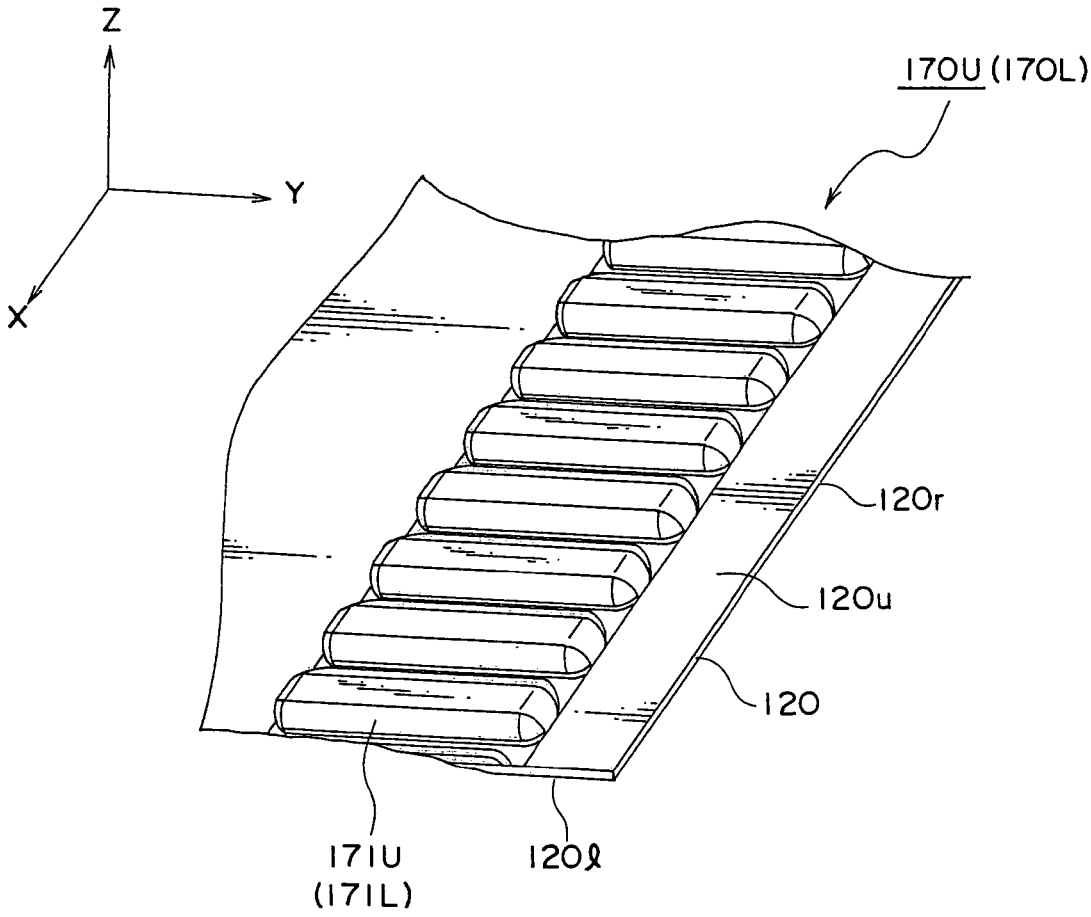
FIG. 22 is a fragmentary perspective view of a portion of an upper elastic member for use in an electrical connector according to a sixth embodiment of this invention.
Figure 23A:
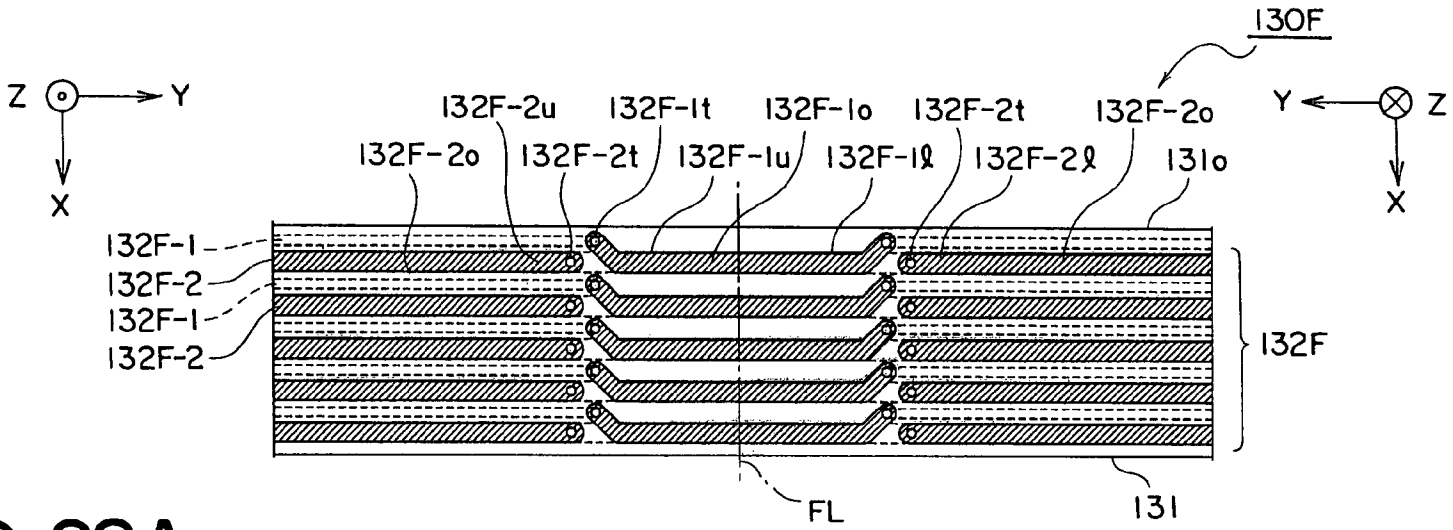
FIG. 23A is a fragmentary development of an outer surface of a flexible conductive film for use in the electrical connector according to the sixth embodiment of this invention.
Figure 23B:
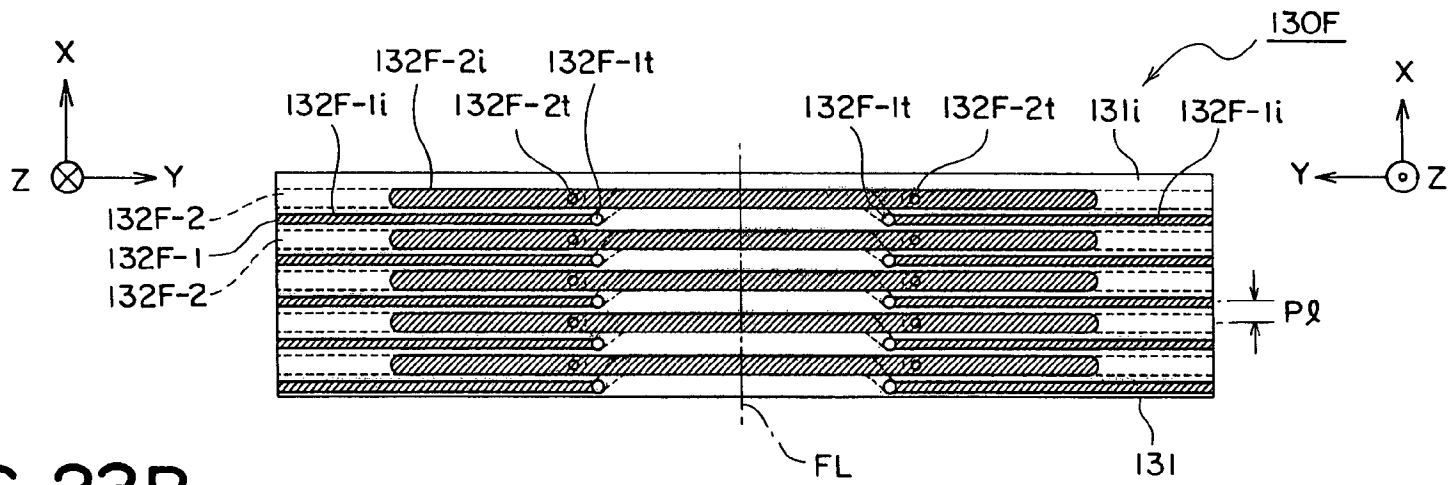
FIG. 23B is a fragmentary development of an inner surface of the flexible conductive film illustrated in FIG. 23A.

Referring to FIGS. 22, 23A, and 23B, the description will proceed to an electrical connector according to a sixth embodiment of this invention. The electrical connector according to the sixth embodiment of this invention is similar in structure to that illustrated in FIGS. 10-14 except that the flexible conductive film and the first and the second elastic members are modified from that illustrated in FIGS. 15A, 15B, 11, and 12 in the manner which will later be described. The flexible conductive film is therefore depicted at a reference symbol of 130F. In addition, the first and the second elastic members are depicted at reference symbols of 170U and 170L, respectively. Similar reference symbols are attached to those similar to the electrical connector 100A in illustrated in FIGS. 10-14 and description thereof is omitted to simplify description.

Inasmuch as the second elastic member 170L is similar in structure to the first elastic member 170U, only the first elastic member 170U is therefore illustrated in FIG. 22.

The first elastic member 170U is called an upper elastic member while the second elastic member 170L is called a lower elastic member. The first and the second elastic members 170U and 170L are fixed to the first and the second surfaces 120*u* and 120*l* of the base member 120.

As shown in FIG. 22, the upper elastic member 170U has a plurality of upper protrusions 171U which jut from the upper elastic member 170U upwards. The upper protrusions 171U are aligned in an upper row at near the rear edge 120*r* of the base member 120 along the lateral direction X. Each of the upper protrusions 171U extends in the back-and-fourth direction Y The upper protrusions 171U are same with each other in the shape and are arranged at regular intervals in the lateral direction X. The regular interval is twice as large as the line pitch PI.

Likewise, the lower elastic member 170L has a plurality of lower protrusions 171L which jut from the lower elastic member 170L downwards. The lower protrusions 171L are aligned in a lower row at near the rear edge 120*r* of the base member 120 along the lateral direction X. Each of the lower protrusions 171L extends in the back-and-fourth direction Y The lower protrusions 171L are same with each other in the shape and are arranged at regular intervals in the lateral direction X. The regular interval is twice as large as the line pitch PI.

As shown in FIGS. 23A and 23B, the flexible conductive film 130F is similar in structure to that illustrated in that illustrated in FIGS. 15A and 15B except that the film conductive pattern is modified from that illustrated in FIGS. 15A and 15B in the manner which will later be described. The film conductive pattern is therefore depicted at a reference symbol of 132F.

In the flexible conductive film 130F of the electrical connector according to the sixth embodiment of this invention, the film conductive pattern 132F is formed not only on the outer surface 131*o* but also on the inner surface 131*i* of the flexible insulating film 131, as shown in FIGS. 23A and 23B.

More specifically, the film conductive pattern 132F consists of a plurality of first and second conductive fine lines 132F-1 and 132F-2 which are arranged along the lateral direction X. In other words, the first and the second conductive fine lines 132F-1 and 132F-2 extend in parallel with each other in the back-and-forth direction Y and are spaced from each other in the lateral direction X at the predetermined line pitch PI. The first conductive fine lines 132F-1 and the second conductive fine lines 132F-2 are alternatively arranged along the lateral direction X. Each of the first and the second conductive fine lines 132F-1 and 132F-2 extends from near the front edge 120*f* of the plate-like base member 120 toward the rear edge 120*r* of the plate-like base member 120 and turns back from near the rear edge 120*r* of the plate-like base member 120 to near the front edge 120*f* of the plate-like base member 120.

Each of the first conductive fine lines 132F-1 has a first upper electrode pad or contact portion 132F-1*u* formed above the corresponding upper protrusion 171U and a first lower electrode pad or contact portion 132F-1*l* formed above the corresponding lower protrusion 171L. The first upper electrode pad 132F-1*u* and the first lower electrode pad 132F-1*l* are formed on the outer surface 131*o* of the flexible insulating film 131.

Each of the first conductive fine lines 132F-1 comprises a first outer conductive line portion 132F-1*o* and a pair of first inner conductive line portions 132F-1*i*. The first outer conductive line portion 132F-1*o* is formed on the outer surface 131*o* of the flexible insulating film 131 and is for electrically connecting the first upper electrode pad 132F-1*u* with the first lower electrode pad 132F-1*l*. That is, the first outer conductive line portion 132F-1*o* acts as a first connection member for electrically connecting the first upper electrode pad 132F-1*u* with the first lower electrode pad 132F-1*l*.

The pair of first inner conductive line portions 132F-1*i* is formed on the inner surface 131*i* of the flexible insulating film 131. One of the pair of first inner conductive line portions 132F-1*i* is electrically connected to the first upper electrode pad 132F-1*u* via a through hole 132F-1*t* while another of the pair of first inner conductive line portions 132F-1*i* is electrically connected to the first lower electrode pad 132F-1*l* via another through hole 132F-1*t*.

Similarly, each of the second conductive fine lines 132F-2 has a second upper electrode pad or contact portion 132F-2*u* formed above the corresponding upper protrusion 171U and a second lower electrode pad or contact portion 132F-2*l* formed above the corresponding lower protrusion 171L. The second upper electrode pad 132F-2*u* and the second lower electrode pad 132F-2*l* are formed on the outer surface 131*o* of the flexible insulating film 131.

Each of the second conductive fine lines 132F-2 comprises a second inner conductive line portion 132F-2*i* and a pair of second outer conductive line portions 132F-2*o*. The second inner conductive line portion 132F-2*i* is formed on the inner surface 131*i* of the flexible insulating film 131 and is for electrically connecting the second upper electrode pad 132F-2*u* with the second lower electrode pad 132F-2*l* via through holes 132F-2*t*. That is, a combination of the second inner conductive line portion 132F-2*i* and the through holes 132F-2*t* serves as a second connection member for electrically connecting the second upper electrode pat 132F-2*u* with the second lower electrode pad 132F-2*l*.

The pair of second outer conductive line portions 132F-2*o* is formed on the outer surface 131*o* of the flexible insulating film 131. One of the pair of second outer conductive line portions 132F-2*o* is electrically connected to the second upper electrode pad 132F-2*u* while another of the pair of second outer conductive line portions 132F-2*o* is electrically connected to the second lower electrode pad 132F-2*l*.

As shown in FIG. 23A, the first upper electrode pad 132F-1*u*, the first lower electrode pad or contact portion 132F-1*l*, the second upper electrode pad 132F-2*u*, and the second lower electrode pad 132F-2*l* are aligned with one another along the back-and-forth direction Y In other words, the first outer conductive line portion 132F-1*o* and the pair of second outer conductive line portions 132F-2*o* are aligned with each other along the back-and-forth direction At any rate, the film conductive pattern 132F is formed not only on the outer surface 131*o* of the flexible insulating film 131 but also on the inner surface 131*i* of the flexible insulating film 131.

Figure 24:
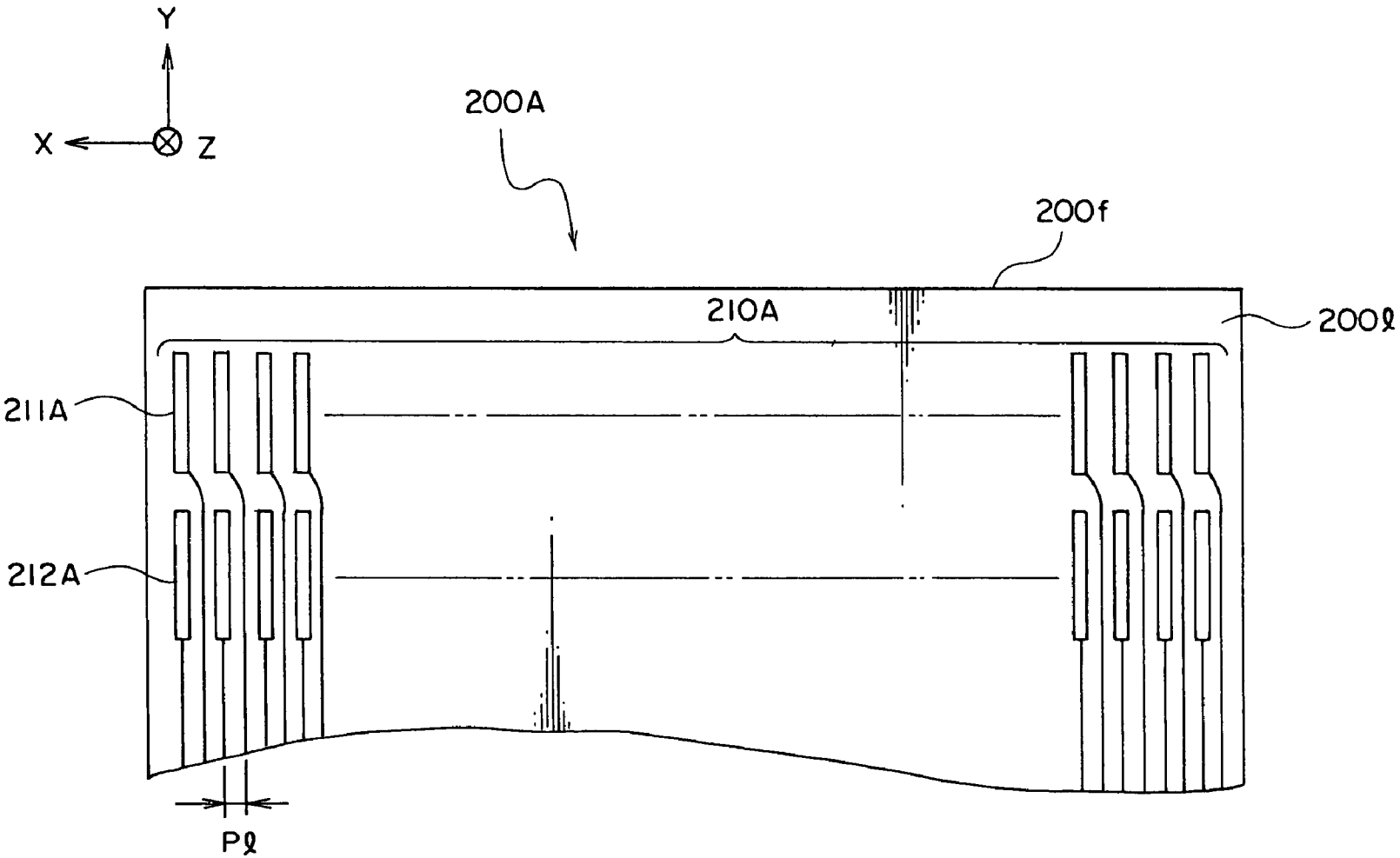
FIG. 24 is a fragmentary plan view of a portion of a flexible printed circuit for use in the electrical connector according to the sixth embodiment of this invention.

Referring to FIG. 24, the description will proceed to a flexible printed circuit (FPC) 200A as the first connection objection board for use in the electrical connector according to the sixth embodiment of this invention. The flexible printed circuit 200A has a lower surface 200*l* on which a first conductive pattern 210A is formed.

The first conductive pattern 210A comprises a plurality of first lower pads or contact portions 211A and a plurality of second lower pads or contact portions 212A. The first lower pads 211A are aligned in a first lower row at near a front edge 200*f* of the flexible printed circuit 200A along the lateral direction X. The second lower pads 212A are aligned in a second lower row apart from the front edge 200*f* along the lateral direction X. The first lower pads 211A and the second lower pads 212A are apart from each other at the predetermined distance in the back-and-forth direction Y In other words, the first lower pads 211A are arranged at regular intervals in the lateral direction X while the second lower pads 212A are arranged at the regular intervals in the lateral direction X. The regular interval is twice as large as the line pitch PI. That is, the first lower pads 211A and the second lower pads 212A are arranged so as to align with each other in the back-and-forth direction Y In other words, the first lower pads 211A and the second lower pads 212A are arranged in parallel with each other along the lateral direction X.

Figure 25:
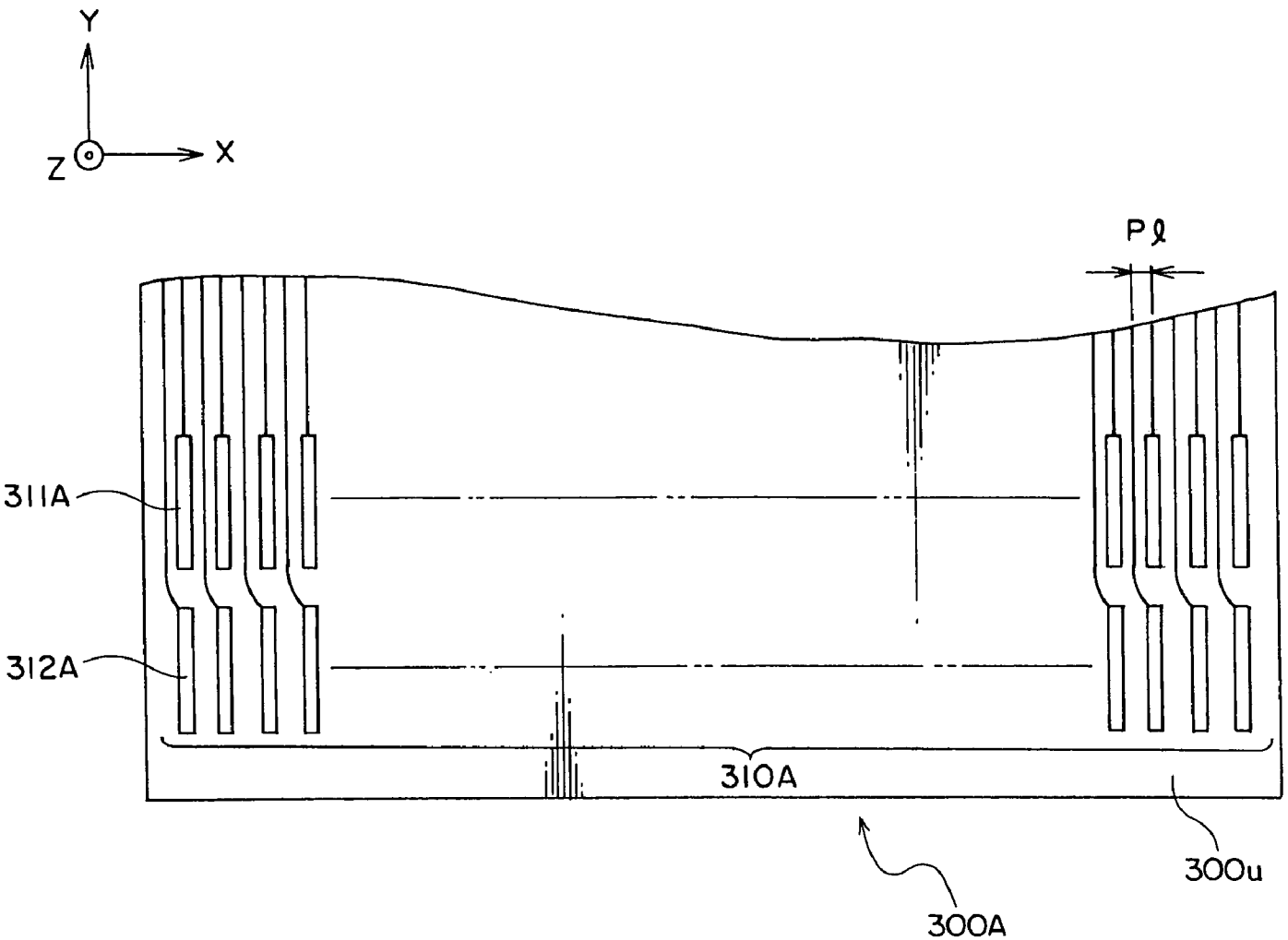
FIG. 25 is a fragmentary plan view of a portion of a printed circuit board for use in the electrical connector according to the sixth embodiment of this invention.

Referring to FIG. 25, the description will proceed to a printed circuit board 300A as the second connection objection board for use in the electrical connector according to the sixth embodiment of this invention. The printed circuit board 300A has an upper surface 300*l* on which a second conductive pattern 310A is formed.

The second conductive pattern 310A comprises a plurality of first upper pads or contact portions 311A and a plurality of second upper pads or contact portions 312A. The first upper pads 311A are aligned in a first upper row along the lateral direction X while the second upper pads 312A are aligned in a second lower row along the lateral direction X. The first upper pads 311A and the second upper pads 312A are apart from each other at the predetermined distance in the back-and-forth direction Y In other words, the first upper pads 311A are arranged at regular intervals in the lateral direction X while the second upper pads 312A are arranged at the regular intervals in the lateral direction X. The regular interval is twice as large as the line pitch PI. That is, the first upper pads 311A and the second upper pads 312A are arranged so as to align with each other in the back-and-forth direction Y In other words, the first upper pads 311A and the second upper pads 312A are arranged in parallel with each other along the lateral direction X.

In the manner which will later be described by using the connecting tool 400, the first and the second upper electrode pads 132F-1*u* and 132F-2*u* of the flexible conductive film 130F are electrically connected to the first and the second lower pads 211A and 212A formed on the lower surface 200*l* of the flexible printed circuit 200A, respectively, while the first and the second lower electrode pads 132F-1*l* and 132F-2*l* of the flexible conductive film 130F are electrically connected to the first and the second upper pads 311A and 312A formed on the upper surface 300*u* of the printed circuit board 300A, respectively. Therefore, the flexible printed circuit 200A and the printed circuit board 300A are electrically connected to each other through the electrical connector.

Referring to FIGS. 26, 27, 28A, and 28B, description will proceed to the connecting tool 400 for electrically connecting the first and the second connection objection boards 200 and 300 through the electrical connector 100A. In the example being illustrated, the first connection objection board 200 comprises the flexible printed circuit (FPC) while the second connection objection board 300 comprises the printed circuit board.

Figure 26:
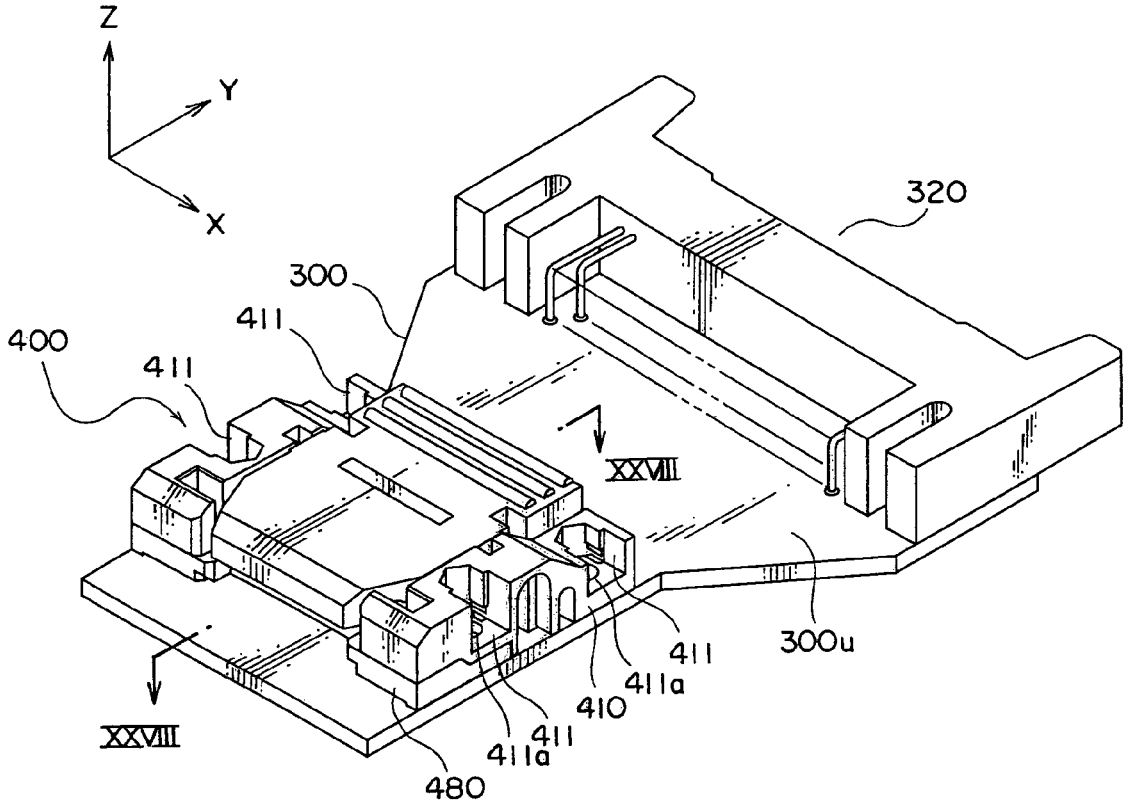
FIG. 26 is a perspective view of a connecting toll mounted on a printed circuit board on which an interface connector is mounted.
Figure 27:
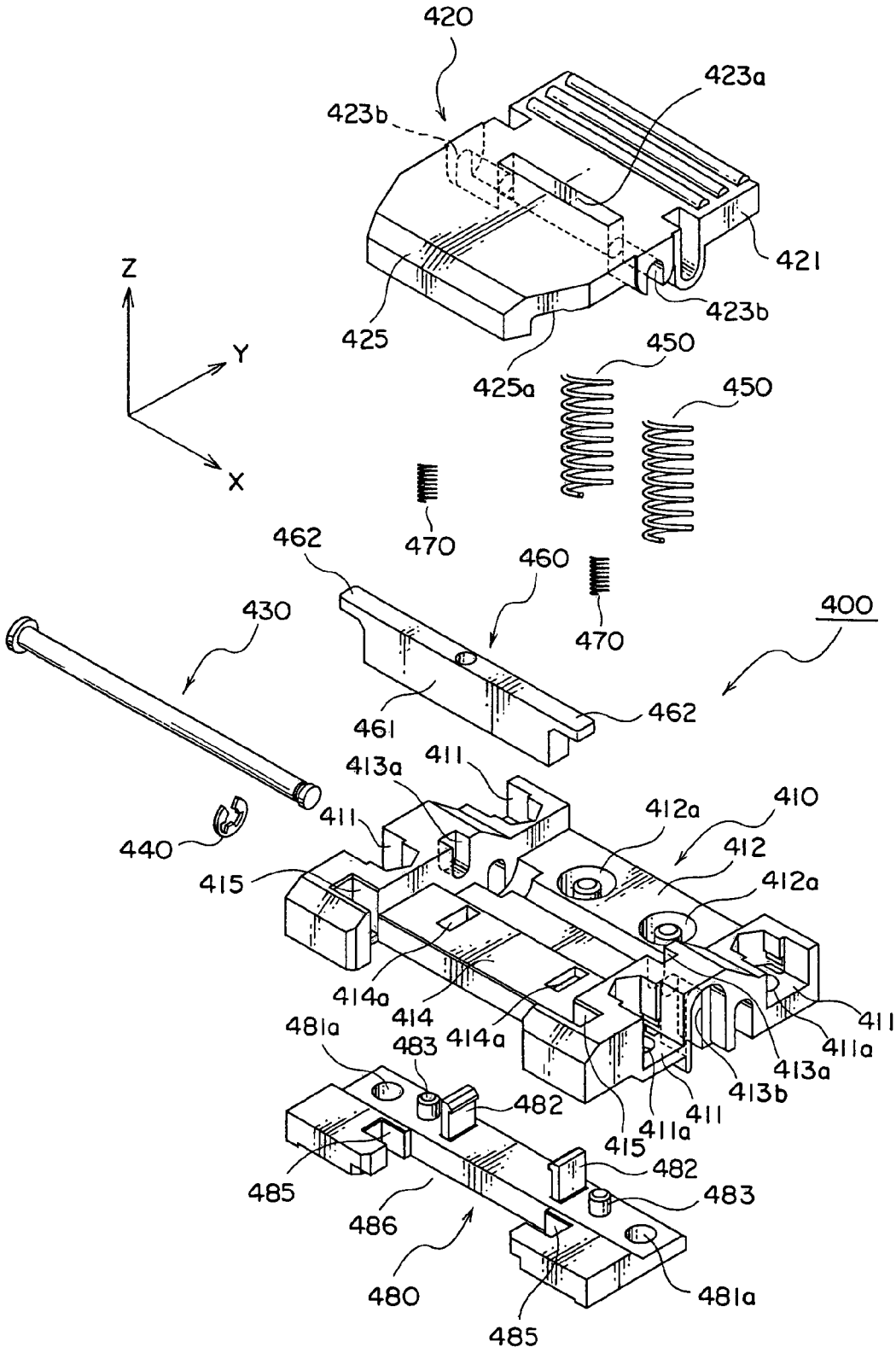
FIG. 27 is an exploded perspective view of the connecting tool illustrated in FIG. 26.
Figure 28A:
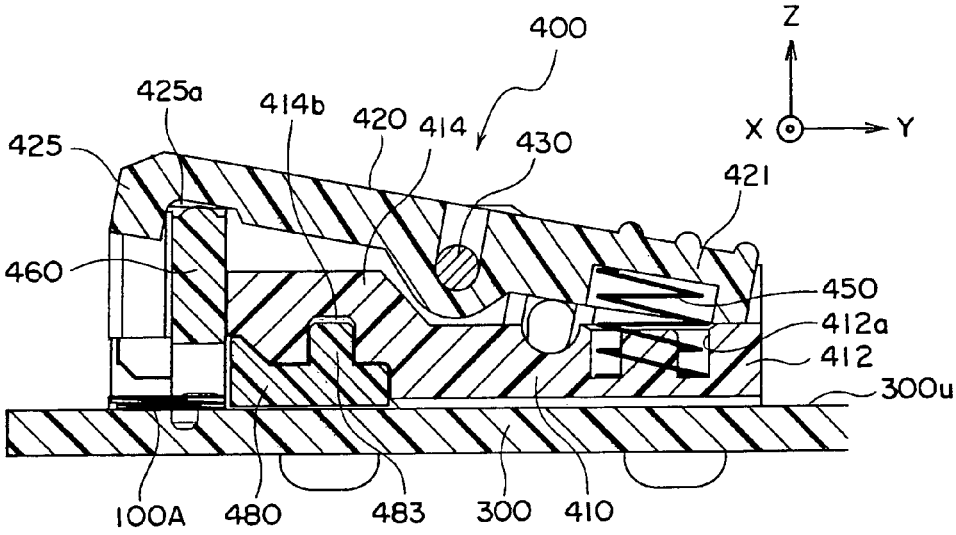
FIG. 28A is a cross-sectional view of the connecting tool taken on line XXVIII-XXVIII of FIG. 26 in a state where the flexible printed circuit is not fitted to the electrical connector yet.
Figure 28B:
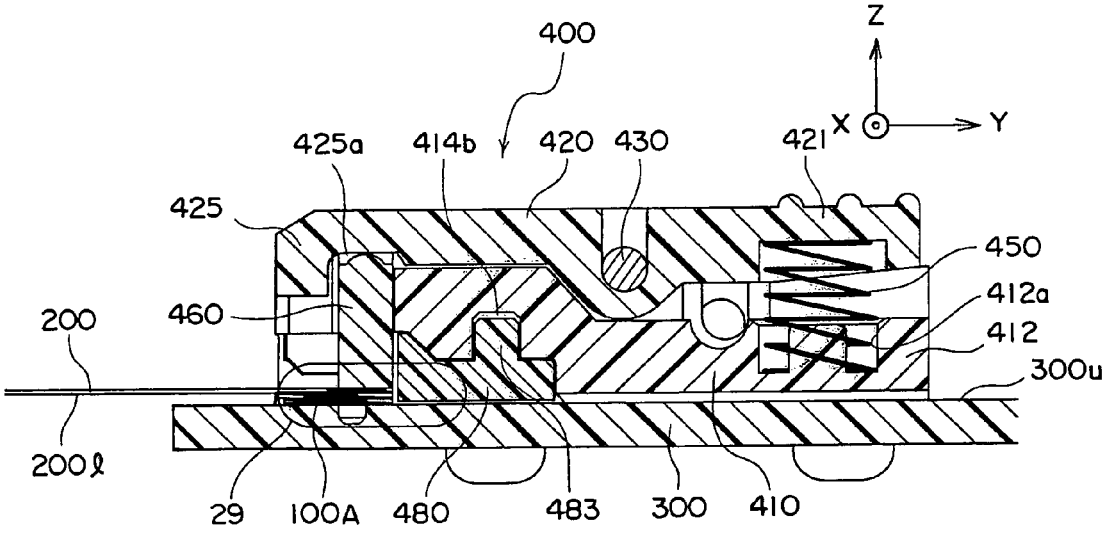
FIG. 28B is a cross-sectional view of the connecting tool taken on line XXVIII-XXVIII of FIG. 26 in a state where the flexible printed circuit is fitted to the electrical connector.

As shown in FIG. 26, an interface connector 320 is mounted on the upper surface 300*u* of the second connection objection board or the printed circuit board 300. As shown in FIG. 28B, the electrical connector 100A is interposed between the flexible printed circuit 200 and the printed circuit board 300 to connect the flexible printed circuit 200 and the printed circuit board 300 to each other.

The connecting tool 400 comprises a base 410 mounted on the upper surface 300*u* of the printed circuit board 300, a cover 420 for covering the base 410, a shaft 430 for rotatably supporting the cover 420 on the base 410, a shaft fastener 440 for preventing the shaft 430 from disconnecting, a pair of first coil springs 450 for lifting the cover 420 up, a pusher 460, held in the cover 420, for pushing the flexible printed circuit 200 toward the electrical connector 100A, a pair of second coil springs 470 for lifting the pusher 460 up, and an inner frame 480 mounted inside the base 410 at a front side of the base 410.

The base 410 has four concave portions 411 each having a through hole 411*a*. The inner frame 480 has two through holes 481*a*. The base 410 and the inner frame 480 are fixed on the upper surface 300*u* of the printed circuit board 300 by threading four screws (not shown) through the four through holes 411*a* and the two through holes 481*a*.

The base 410 comprises a rear plate 412 having a pair of cylindrical-shaped holes 412*a*. The pair of first coil springs 450 is inserted through the pair of cylindrical-shaped holes to dispose them on the rear plate 412 of the base 410. The cover 420 comprises a pushing plate 421 at a rear side thereof. The pair of first coil springs 450 is disposed between the rear plate 412 of the base 410 and the pushing plate 421 of the cover 420, as shown in FIGS. 28A and 28B. Therefore, the pair of first coil springs 450 serves as a first urging member for urging the pushing plate 421 of the cover 420 upwards. In other words, the first urging member 450 urges the cover 420 so as to rotate the cover 420 around the shaft 430 in a direction that pushes the pusher 460.

The base 410 has a pair of U-shaped ditches 413*a* at both sides of a center portion thereof and a pair of inverse U-shaped ditches 413*b* which communicates with the pair of U-shaped ditches 413*a*. On the other hand, the cover 420 has a U-shaped ditch 423*a* at a center portion thereof extending in the lateral direction X and a pair of inverse U-shaped ditches 423*b* which communicates with the U-shaped ditch 423*a*. The shaft 430 extends in the lateral direction X. The shaft 430 is inserted in the pair of U-shaped ditches 413*a*, the pair of inverse U-shaped ditches 413*b*, the pair of inverse U-shaped ditches 423*b*, and the U-shaped ditch 423*a*. The shaft fastener 440 fastens the shaft 430 at an end thereof. Therefore, the cover 421 is rotatably supported on the base 410 around the shaft 430.

The base 410 comprises a front plate 414 having a pair of rectangular holes 414*a* and a pair of concave portions 414*b* formed on a lower surface the front plate 414 at both sides of the pair of rectangular holes 414*a*. The inner frame 480 comprises a pair of hook portions 482 projecting from the inner frame 480 upwards and a pair of protrusions 483 jutting from the inner frame 480 upwards. The pair of hook portions 482 is inserted in the pair of rectangular holes 414*a* to lock the inner frame 480 in the base 410 and the pair of protrusions 483 is inserted in the pair of concave portions 414*b* to position the inner frame 480 for the base 410.

The base 410 comprises a pair of rectangular concave portions 415 at both sides of a front thereof. Each of rectangular concave portions 415 has a projection (not shown). The pusher 460 comprises a pusher body 461 extending in the lateral direction X and a pair of arms 462 at both sides of an upper end of the pusher body 461 that extends in the lateral direction X. The inner frame 480 has a pair of rectangular notches 485 at both sides of a front thereof. The cover 420 comprises a front plate 425 having a concave portion 425*a* extending in the lateral direction X. The pusher body 461 of the pusher 460 is inserted between the pair of rectangular notches 485 of the inner frame 480. The pair of arms 462 of the pusher 460 is inserted in the pair of rectangular concave portions 415 with the pair of second coil springs 470 sandwiched between the pair of arms 462 and base portions of the pair of rectangular concave portions 415. In this event, the above-mentioned projections in the pair of rectangular concave portions 415 are inserted in the pair of coil springs 450. An upper surface of the pusher 460 is engaged with the concave portion 425*a* of the front plate 425 of the cover 420.

At any rate, the pair of the second coil springs 470 serves as a second urging member for urging the pusher 470 upwards. In other words, the second urging member 470 urges the pusher 470 so as to move the pusher away from the electrical connector 100A. Inasmuch as the pair of first coil springs 450 has first urging force which is stronger than second urging force of the pair of the second coil springs 470, the cover 430 rotates around the shaft 430 counterclockwise in FIGS. 28A and 28B if any pushing force does not act on the pushing plate 421 of the cover 420.

The inner frame 480 has an opening 486 for receiving the flexible printed circuit 200 and the electrical connector 100A in the manner which will later be described.

In addition, a combination of the electrical connector 100A and the connecting tool 400 serves as a connecting device for electrically connecting the flexible printed circuit 200 with the printed circuit board 300 in the manner which will later be described.

Figure 29:
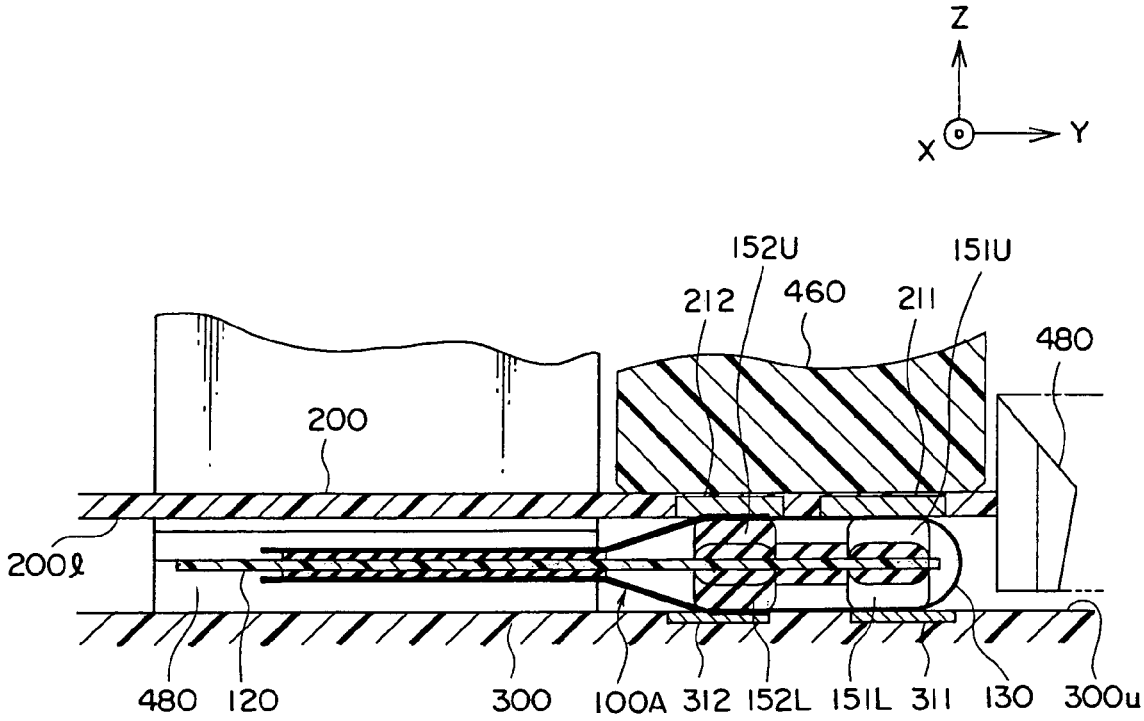
FIG. 29 is an enlarged view of a connected state enclosed in an ellipse 29 in FIG. 28B.

Referring to FIGS. 28A and 28B in addition to FIG. 29, description will be made of a method of electrically connecting the flexible printed circuit 200 with the printed circuit board 300 via the electrical connector 100A by use of the connection tool 400. FIG. 28A is a cross-sectional view of the connecting tool 400 taken on line XXVIII-XXVIII of FIG. 26 in a state where the flexible printed circuit 200 is not fitted to the electrical connector 100A yet. FIG. 28B is across-sectional view of the connecting tool 400 taken on line XXVIII-XXVIII of FIG. 26 in a state where the flexible printed circuit 200 is fitted to the electrical connector 100A. FIG. 29 is an enlarged view of a connected state enclosed in an ellipse 29 in FIG. 28B.

In FIG. 28A, an upper surface of the pushing plate 421 in the cover 420 is pushed by a finger (not shown) downwards. Accordingly, the cover 420 rotates around the shaft 430 clockwise. In this event, the pair of first coil springs 450 is compressed while the pair of second coil springs 470 extends to lift the pusher 460 up. Therefore, the upper end of the pusher 460 is in contact with an inner surface of the front plate 425 of the cover 420.

In a state of FIG. 28A, the flexible printed circuit 200 is inserted in the opening 486 of the inner frame 480 in the connecting tool 400 to dispose the flexible printed circuit 200 on the electrical connector 100A. Thereafter, the finger releases the upper surface of the pushing plate 421 in the cover 420. In this event, the cover 420 rotates around the shaft 430 counterclockwise by urging force of the pair of first coil springs 450. Accordingly, the pusher 460 is pushed down by the front plate 425 of the cover 420 to press the flexible printed circuit 200 against the electrical connector 100A, as shown in FIG. 28B.

As shown in FIG. 29, the electrical connector 100A is mounted in the inner frame 480 and is mounted on the upper surface 300*u* of the printed circuit board 300. The flexible printed circuit 200 is mounted on the electrical connector 100A and the flexible printed circuit 200 is pressed against the electrical connector 100A by the pusher 460, in the manner which is described above.

In FIG. 29, when the pusher 460 pushes the upper surface of the flexible printed circuit 100A down, the first and the second lower pads 211 and 212 formed on the lower surface 200*l* of the flexible printed circuit 200 are in contact with the first and the second upper electrode pads 132A-1*u* and 132A-2*u* of the upper surface of the electrical connector 100A while the first and the second upper pads 311 and 312 formed on the upper surface 300*u* of the printed circuit board 300 are in contact with the first and the second lower electrode pads 132A-1*l* and 132A-2*l* of the lower surface of the electrical connector 100A. Accordingly, the flexible printed circuit 200 is electrically connected to the printed circuit board 300 through the electrical connector 100A.

While this invention has thus far been described in conjunction with several preferred embodiments thereof, it will now readily possible for those skilled in the art to put this invention into various manners. For example, although the double-sided adhesive sheet is used as the adhesive member for fixing the flexible insulating film to the base member in the above-mentioned embodiments, the adhesive member is not restricted to the double-sided adhesive sheet. In addition, although the pair of coil springs is used as the urging member in the above-mentioned embodiment, the urging member is not restricted to the pair of coil springs.

What is claimed is:

1. A connecting tool for electrically connecting a first connection objection board with a second connection objection board through an electrical connector interposed between said first connection objection board and said second connection objection board, said connecting tool comprising:

a base mounted on said second connection objection board;

a cover for covering said base;

a shaft for rotatably supporting said cover on said base;

a pusher, held in said cover, for pushing said first connection objection board toward said electrical connector;

a first urging member for urging said cover so as to rotate said cover around said shaft in a direction that pushes said pusher; and a second urging member for urging said pusher so as to move said pusher away from said electrical connector;

wherein said second urging member comprises a pair of second coil springs disposed between said base and said pusher.

2. The connecting tool as claimed in claim 1, wherein further comprises an inner frame mounted inside said base, said inner frame having an opening for receiving said first connection objection board and said electrical opening for receiving said first connection objection board and said electrical connector.

3. The connecting tool as claimed in claim 1, wherein said first urging member comprises a pair of first coil springs disposed between said base and said cover.

4. A connecting device comprising:

an electrical connector interposed between a first connection objection board and a second connection objection board; and a connecting tool for electrically connecting said first connection objection board with said second connection objection board through said electrical connector, wherein said connecting tool comprises:

a base mounted on said second connection objection board;

a cover for covering said base;

a shaft for rotatably supporting said cover on said base;

a pusher, held in said cover, for pushing said first connection objection board toward said electrical connector;

a first urging member for urging said cover so as to rotate said cover around said shaft in a direction that pushes said pusher; and a second urging member for urging said pusher so as to move said pusher away from said electrical connector;

wherein said second urging member comprises a pair of second coil springs disposed between said base and said pusher.

5. The connecting device as claimed in claim 4, wherein said connecting tool further comprises an inner frame mounted inside said base, said inner frame having an opening for receiving said first connection objection board and said electrical connector.

6. The connecting device as claimed in claim 4, wherein said first urging member comprises a pair of first coil springs disposed between said base and said cover.

* * * * *